US006179013B1

(12) United States Patent
Gulya

(10) Patent No.: US 6,179,013 B1
(45) Date of Patent: Jan. 30, 2001

(54) LOW CALIPER MULTI-LAYER FORMING FABRICS WITH MACHINE SIDE CROSS MACHINE DIRECTION YARNS HAVING A FLATTENED CROSS SECTION

(75) Inventor: Thomas G. Gulya, Raleigh, NC (US)

(73) Assignee: Weavexx Corporation

( * ) Notice: Under 35 U.S.C. 154(b), the term of this patent shall be extended for 0 days.

(21) Appl. No.: 09/422,667

(22) Filed: Oct. 21, 1999

(51) Int. Cl.[7] ..... D21F 1/00
(52) U.S. Cl. ..... 139/383 A
(58) Field of Search ..... 139/383 A

(56) References Cited

U.S. PATENT DOCUMENTS

| | | |
|---|---|---|
| Re. 33,195 | 4/1990 | McDonald et al. . |
| Re. 35,777 | 4/1998 | Givin . |

(List continued on next page.)

FOREIGN PATENT DOCUMENTS

| | | |
|---|---|---|
| 1115177 | 12/1981 | (CA) . |
| 2-277848 | 11/1990 | (CN) . |
| 454 092 | 12/1927 | (DE) . |
| 33 29 740 | 3/1985 | (DE) . |
| 0 048 962 | 9/1981 | (EP) . |
| 0 158 710 | 10/1984 | (EP) . |
| 0 185 177 | 10/1985 | (EP) . |
| 0 224 276 | 12/1986 | (EP) . |
| 0 264 881 | 10/1987 | (EP) . |
| 0 269 070 | 11/1987 | (EP) . |
| 0 284 575 | 2/1988 | (EP) . |
| 0 283 181 | 3/1988 | (EP) . |
| 0 350 673 | 6/1989 | (EP) . |
| 0 048 849 A2 | 5/1990 | (EP) . |
| 0 048 849 A3 | 5/1990 | (EP) . |
| 0 672 782 | 3/1995 | (EP) . |
| 0 794 283 A1 | 9/1997 | (EP) . |
| 2 597 123 | 4/1986 | (FR) . |
| 8605115 | 4/1986 | (FR) . |
| 2157328A | 10/1985 | (GB) . |
| 2245006 | 2/1991 | (GB) . |
| 8-158285 | 12/1994 | (JP) . |
| 9-41282 | 7/1995 | (JP) . |
| 9-87990 | 9/1995 | (JP) . |
| WO 86/00099 | 1/1986 | (WO) . |
| WO 89/09848 | 4/1989 | (WO) . |
| WO 93/10304 | 11/1992 | (WO) . |

OTHER PUBLICATIONS

Warren, C.A., "The Importance of Yarn Properties in Wet–End Wire Construction," Seminar, The Theory of Water Removal, Dec. 12, 1979.
International Search Report for PCT Application No. PCT/US97/18629.
Rule 132 Declaration of Robert G. Wilson (Jun. 26, 1997).
Declaration of Robert G. Wilson, dated Aug. 10, 2000.

* cited by examiner

*Primary Examiner*—Andy Falik
(74) *Attorney, Agent, or Firm*—Myers Bigel Sibley & Sajovec

(57) ABSTRACT

Multi-layer papermaker's fabrics are provided which include flattened bottom fabric cross machine direction yarns that advantageously reduce the void volume and water carry of the fabric. These flattened yarns may be of oval, rectangular or other shape. These fabrics preferably include a relatively large number of cross machine direction yarns on the papermaking surface and/or a papermaking surface having single float machine direction knuckles, so as to provide a high level of fiber support and good papermaking qualities. The fabrics also preferably include good drainage paths between the flattened bottom cross machine direction yarns.

24 Claims, 13 Drawing Sheets

U.S. PATENT DOCUMENTS

| | | | | |
|---|---|---|---|---|
| 2,172,430 | | 9/1939 | Barrell . | |
| 2,554,034 | | 5/1951 | Koester et al. . | |
| 3,094,149 | | 6/1963 | Keily . | |
| 3,325,909 | | 6/1967 | Clark . | |
| 4,093,512 | | 6/1978 | Fleischer . | |
| 4,182,381 | | 1/1980 | Gisbourne . | |
| 4,244,543 | | 1/1981 | Ericson . | |
| 4,289,173 | | 9/1981 | Miller . | |
| 4,290,209 | | 9/1981 | Buchanan et al. . | |
| 4,414,263 | | 11/1983 | Miller et al. . | |
| 4,438,788 | | 3/1984 | Harwood . | |
| 4,452,284 | | 6/1984 | Eckstein et al. . | |
| 4,453,573 | | 6/1984 | Thompson . | |
| 4,501,303 | | 2/1985 | Osterberg . | |
| 4,515,853 | | 5/1985 | Borel . | |
| 4,529,013 | | 7/1985 | Miller . | |
| 4,564,052 | | 1/1986 | Borel . | |
| 4,592,395 | | 6/1986 | Borel . | |
| 4,592,396 | | 6/1986 | Borel et al. . | |
| 4,605,585 | | 8/1986 | Johansson . | |
| 4,611,639 | | 9/1986 | Bugge . | |
| 4,621,663 | | 11/1986 | Malmendier . | |
| 4,633,596 | | 1/1987 | Josef . | |
| 4,636,426 | | 1/1987 | Fleischer . | |
| 4,642,261 | | 2/1987 | Fearnhead . | |
| 4,676,278 | | 6/1987 | Dutt . | |
| 4,705,601 | | 11/1987 | Chiu . | |
| 4,709,732 | | 12/1987 | Kinnunen . | |
| 4,729,412 | | 3/1988 | Bugge . | |
| 4,731,281 | | 3/1988 | Fleischer et al. . | |
| 4,739,803 | | 4/1988 | Borel . | |
| 4,755,420 | | 7/1988 | Baker et al. . | |
| 4,759,975 | | 7/1988 | Sutherland et al. . | |
| 4,815,499 | | 3/1989 | Johnson . | |
| 4,815,503 | | 3/1989 | Borel . | |
| 4,909,284 | | 3/1990 | Kositzke . | |
| 4,934,414 | | 6/1990 | Borel . | |
| 4,941,514 | | 7/1990 | Taipale . | |
| 4,942,077 | | 7/1990 | Wendt et al. . | |
| 4,945,952 | | 8/1990 | Vöhringer . | |
| 4,967,805 | | 11/1990 | Chiu et al. . | |
| 4,987,929 | | 1/1991 | Wilson . | |
| 4,989,647 | | 2/1991 | Marchand . | |
| 4,989,648 | | 2/1991 | Tate et al. . | |
| 4,998,568 | | 3/1991 | Vohringer . | |
| 4,998,569 | | 3/1991 | Tate . | |
| 5,025,839 | | 6/1991 | Wright . | |
| 5,074,339 | | 12/1991 | Vohringer . | |
| 5,084,326 | | 1/1992 | Vohringer . | |
| 5,092,372 | | 3/1992 | Fitzka et al. . | |
| 5,101,866 | | 4/1992 | Quigley . | |
| 5,114,777 | * | 5/1992 | Gaisser | 139/383 A |
| 5,116,478 | | 5/1992 | Tate et al. . | |
| 5,152,326 | | 10/1992 | Vohringer . | |
| 5,158,118 | | 10/1992 | Tate et al. . | |
| 5,219,004 | | 6/1993 | Chiu . | |
| 5,228,482 | | 7/1993 | Fleischer . | |
| 5,358,014 | | 10/1994 | Kovar . | |
| 5,421,374 | | 6/1995 | Wright . | |
| 5,421,375 | | 6/1995 | Praetzel . | |
| 5,429,686 | | 7/1995 | Chiu et al. . | |
| 5,449,026 | | 9/1995 | Lee . | |
| 5,454,405 | | 10/1995 | Hawes . | |
| 5,456,293 | | 10/1995 | Ostermayer et al. . | |
| 5,465,754 | | 11/1995 | Eschmann et al. . | |
| 5,482,567 | | 1/1996 | Barreto . | |
| 5,487,414 | | 1/1996 | Kuji et al. . | |
| 5,518,042 | | 5/1996 | Wilson . | |
| 5,520,225 | | 5/1996 | Quigley et al. . | |
| 5,542,455 | | 8/1996 | Ostermayer et al. . | |
| 5,555,917 | | 9/1996 | Quigley . | |
| 5,564,475 | | 10/1996 | Wright . | |
| 5,613,527 | * | 3/1997 | Zimmermann et al. | 139/383 A |
| 5,641,001 | | 6/1997 | Wilson . | |
| 5,651,394 | | 7/1997 | Marchand . | |
| 5,709,250 | | 1/1998 | Ward et al. . | |
| 5,713,396 | * | 2/1998 | Lee | 139/383 A |
| 5,746,257 | | 5/1998 | Fry . | |
| 5,826,627 | | 10/1998 | Seabrook et al. . | |
| 5,865,219 | * | 2/1999 | Lee et al. | 139/383 A |
| 5,881,764 | | 3/1999 | Ward . | |
| 5,937,914 | | 8/1999 | Wilson . | |

LOW CALIPER MULTI-LAYER FORMING FABRICS WITH MACHINE SIDE CROSS MACHINE DIRECTION YARNS HAVING A FLATTENED CROSS SECTION

FIELD OF THE INVENTION

The present invention relates generally to papermaking, and relates more specifically to fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a drier section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joiner machines are now commercially available, which for certain fabrics may be used to automate at least part of the joining process. In a flat woven papermaker's fabric, the warp yarns extend in the machine direction and the filling yarns extend in the cross machine direction. In the second technique, fabrics are woven directly in the form of a continuous belt with an endless weaving process. In the endless weaving process, the warp yarns extend in the cross machine direction and the filling yarns extend in the machine direction. As used herein, the terms "machine direction" (MD) and "cross machine direction" (CMD) refer, respectively, to a direction aligned with the direction of travel of the papermakers' fabric on the papermaking machine, and a direction parallel to the fabric surface and traverse to the direction of travel. Both weaving methods described hereinabove are well known in the art, and the term "endless belt" as used herein refers to belts made by either method.

Effective sheet and fiber support and an absence of wire marking are important considerations in papermaking, especially for the forming section of the papermaking machine, where the wet web is initially formed. Wire marking is particularly problematic in the formation of fine paper grades, as it affects a host of paper properties, such as sheet mark, porosity, "see through" and pin holing. Wire marking is the result of individual cellulosic fibers being oriented within the paper web such that their ends reside within gaps between the individual threads or yarns of the forming fabric. This problem is generally addressed by providing a permeable fabric structure with a coplanar surface that allows paper fibers to bridge adjacent yarns of the fabric rather than penetrate the gaps between yarns. As used herein, "coplanar" means that the upper extremities of the yarns defining the paper-forming surface are at substantially the same elevation, such that at that level there is presented a substantially "planar" surface. Accordingly, fine paper grades intended for use in quality printing, carbonizing, cigarettes, electrical condensers, and like grades of fine paper have typically heretofore been formed on very finely woven or fine wire mesh forming fabrics.

Typically, such finely woven fabrics include at least some relatively small diameter machine direction or cross machine direction yarns. Regrettably, however, such yarns tend to be delicate, leading to a short surface life for the fabric. Moreover, the use of smaller yarns can also adversely effect the mechanical stability of the fabric (especially in terms of skew resistance, narrowing propensity and stiffness), which may negatively impact both the service life and the performance of the fabric.

To combat these problems associated with fine weaves, multi-layer forming fabrics have been developed with fine-mesh yarns on the paper forming surface to facilitate paper formation and coarser-mesh yarns on the machine contact side to provide strength and durability. For example, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. As double and triple layer fabrics include additional sets of yarn as compared to single layer fabrics, these fabrics typically have a higher "caliper" (i.e., they are thicker than) comparable single layer fabrics. An illustrative double layer fabric is shown in U.S. Pat. No. 4,934,414 to Borel, and illustrative triple layer fabrics are shown in U.S. Pat. No. 4,501,303 to Osterberg, U.S. Pat. No. 5,152,326 to Vohringer, and U.S. Pat. No. 5,437,315 to Ward.

Although these fabrics have performed successfully, they have some shortcomings. For instance, the separate stitching yarns that are included in typical triple layer fabrics can adversely affect the appearance of the paper that is formed on the fabric. Additionally, these traditional triple layer fabrics are also susceptible to interlayer wear problems, which may occur as the result of the top and bottom layers of the fabric shifting relative to one another (in the machine direction and the cross machine direction) during operation. This shifting can cause the fabric to wear out prematurely, and may also cause the layers to become offset from one another, which can adversely affect the drainage, and hence the papermaking performance, of the fabric. Moreover, many double layer, triple layer and other "multi-layer" forming fabrics have a relatively large "void volume", which refers to the volume of the open space in the interior of the fabric. Large void volumes can translate into high water carry, meaning that the fabric tends to carry a large amount of undrained water which may negatively impact the fabrics ability to drain water from the paper web which is being formed, thereby increasing the water removal requirements of the press and dryer sections of the papermaking machine. It is generally preferable, however, to remove as much water as possible in the forming section of the fabric, because the energy costs in the press and dryer sections of the papermaking machine typically exceed the energy costs of the forming section. Excessive water carry may also degrade vacuum drainage and sheet consistency off the couch roll, both of which may negatively impact the quality of the resulting paper.

With the development of synthetic yarns, shaped monofilament yarns have been employed in the construction of papermaker's fabrics. For example, U.S. Pat. No. 5,465,764 to Eschmann et al., U.S. Pat. No. 4,621,663 to Malmendier, U.S. Pat. No. 4,438,788 to Harwood, U.S. Pat. No. 4,755,420 to Baker et al., U.S. Pat. No. 5,449,026 to Lee and U.S. Pat. No. 4,290,209 to Buchanan et al disclose the use of flat or rectangular shaped yarns in dryer fabric applications. The fabrics disclosed in these patents primarily use the flat yarns on the paper-contacting surface, and primarily implement the machine direction yarns using flat yarns. Other references also disclose the use of flat or oval yarns in press felt applications, including U.S. Pat. No. 5,651,394 to Marchand and U.S. Pat. No. 4,414,263 to Miller et al. Finally, U.S. Pat. No. 4,815,499 to Johnson and U.S. Pat. No. 4,705,601 to Chiu, as well as U.K. Patent Application 2,157,328A disclose multi-layer forming fabrics which include oval or rectangular warp yarns.

SUMMARY OF THE INVENTION

In view of the foregoing, it is an object of the present invention to provide lower caliper multi-layer forming fabrics that preferably have reduced water carry.

It is another object of the present invention to provide a multi-layer forming fabric construction that has a fine papermaking surface that provides a high amount of fiber support.

It is a further object of the present invention to provide a multi-layer forming fabric that has a good life potential.

These and other objects are satisfied by the present invention, which relates to multi-layer papermaker's fabrics which include bottom fabric layer (machine side) cross machine direction yarns that have oval, rectangular or other flattened cross section ("flattened yarns"). These flattened yarns are woven into the fabric so that their major axis falls in the same plane as the paper web which is formed on the fabric, thereby reducing the thickness or "caliper" of the fabric. In this manner, the void volume of the fabric may in many instances be reduced. Preferably, a set of "primary" top CMD yarns are stacked above the flattened bottom CMD yarns, and auxiliary top layer CMD yarns (such as paired stitching yarns or "x-pick" yarns) are included between adjacent primary top CMD yarns. Such a configuration may create good drainage paths between the flattened bottom fabric layer CMD yarns, which otherwise (due to their large major axis in the machine direction) could potentially close-up the bottom of the fabric. It is also preferred that the fabrics of the present invention include a relatively large number of cross machine direction yarns or "picks" on the papermaking surface and/or a papermaking surface having single float machine direction knuckles, so as to provide a high level of fiber support and good papermaking qualities.

In one aspect of the present invention, multi-layer papermaker's forming fabrics are provided that include at least one set of machine direction yarns, a set of top cross machine direction yarns and a set of bottom cross machine direction yarns which are interwoven to form a top fabric layer having a papermaking surface and a bottom fabric layer having a machine side surface. Each yarn in the set of bottom cross machine directions yarns is flattened, in that it does not have a circular cross section, but instead has an oval, rectangular, or otherwise flattened cross section, and preferably, the aspect ratio (defined below) of these oval yarns is greater than 1.3 but less than 2.5. In a preferred configuration of this fabric, a set of auxiliary top cross machine direction yarns are also provided, which are interwoven with the at least one set of machine direction yarns. Moreover, the top and bottom cross machine direction yarns may also be substantially stacked.

In a particular embodiment of the present invention, triple layer forming fabrics are provided. In these fabrics, both top and bottom sets of machine direction yarns are provided, and the set of auxiliary top cross machine direction yarns comprises a set of stitching cross machine direction yarns that bind the top and bottom layers of the triple layer fabric. This set of stitching yarns may comprise pairs of adjacent stitching yarns that are woven into the fabric such that when the first yarn of a pair is weaving in the top fabric layer the other yarn of the pair is passing downwardly from the top fabric layer to interweave with the bottom fabric layer. In this embodiment, the pairs of adjacent stitching yarns may be positioned between adjacent yarns in the set of top cross machine direction yarns. Preferably, the yarns in the set of top machine direction yarns pass over no more than one of any two adjacent yarns in the set of top cross machine direction yarns, and the pairs of adjacent stitching yarns each serve as locator yarns at the points where the yarns of the pair cross each other in entering or leaving the papermaking surface. Additionally, in one particular embodiment, the set of stitching yarns may be used to complete a weave pattern (such as a plain weave or a 1×2 twill) on the papermaking surface which is partially formed by the interweaving of the set of top machine direction yarns and the set of top cross machine direction yarns. In another embodiment of the present invention, double layer forming fabrics are provided. In this embodiment, at least one auxiliary top cross machine direction yarn may be provided between each pair of adjacent primary top cross machine direction yarns.

In another aspect of the present invention, auto-joinable multi-layer papermaker's forming fabrics are provided which include at least one set of machine direction yarns, a set of top cross machine direction yarns and a set of bottom cross machine direction yarns interwoven to form a forming fabric having a top fabric layer and a bottom fabric layer. Once again, at least some of the yarns in the set of bottom cross machine direction yarns have a flattened cross section. In one embodiment of this fabric, the ratio between the number of top cross machine direction yarns and bottom cross machine direction yarns is approximately one-to-one and the fabric preferably has at least 80 picks per inch on its papermaking surface. Preferably, in this embodiment adjacent of the flattened bottom cross machine direction yarns are spaced apart by at least 0.1 mm to facilitate use of various auto-joining machines.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the illustrated or other embodiments set forth herein; rather, these embodiments are provided so that this disclosure will be thorough and complete, and will fully convey the scope of the invention to those skilled in the art. Like numbers refer to like elements throughout. In the figures, the dimensions of some components may be exaggerated for clarity.

Pursuant to one aspect of the present invention, triple layer papermaker's forming fabrics are provided that comprise a top fabric layer, a bottom fabric layer, and stitching yarns which bind the layers together. Pursuant to the teachings of the present invention, such fabrics may be constructed to have a relatively low caliper by using "flattened" cross machine direction yarns in the bottom fabric layer. By weaving these flattened yarns into the bottom fabric layer so that the major axis of their cross-section is in the same plane as the top surface of the fabric, it is possible to construct relatively low caliper forming fabrics which have good mechanical stability.

Figure 16A:
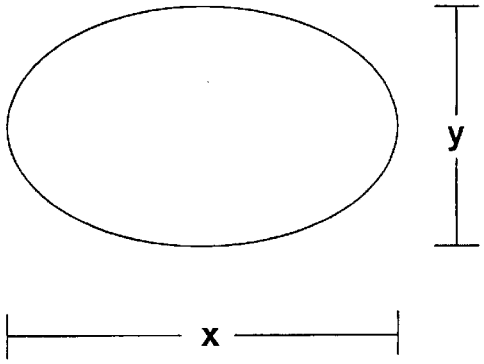
FIGS. 16A–16D depict various embodiments of flattened yarns which may be used in the fabrics of the present invention.

FIGS. 16A–16D illustrate several different flattened yarn configurations which are suitable for use as "flattened" bottom cross machine direction yarns in the fabrics described herein. In FIG. 16A, the flattened yarn is oval in shape, having a major axis designated by the letter "x" and a minor axis designated by the letter "y". The ratio of x to y is referred to herein as the aspect ratio of the non-circular or "flattened" yarns. Preferably, this aspect ratio is greater than 1.3 and less than 2.5. The lower boundary on aspect ratio reflects the fact that if bottom fabric layer CMD yarns having an aspect ratio that is not much different than 1.0 are used, there is little reduction in the caliper of the fabric, and hence the void volume and water carry of the fabric may not be appreciably reduced. Moreover, aspect ratios significantly larger than 2.5 generally are not preferred because (i) yarns which are relatively thin along one axis may be susceptible to wear and breaking, and hence may reduce the overall life of the fabric and (ii) some degree of crimp may be required for autojoining the fabric. For many fabrics, it may be more preferred that the aspect ratio is greater than 1.5 and less than 2.0.

Figure 16B:
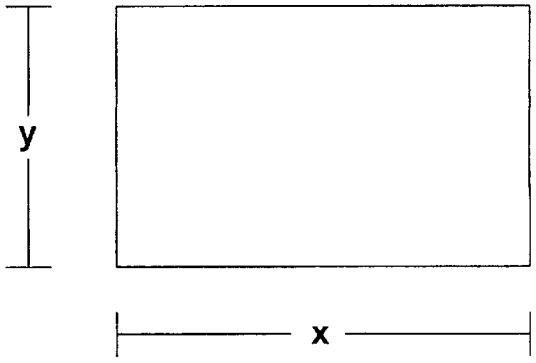
Figure 16C:
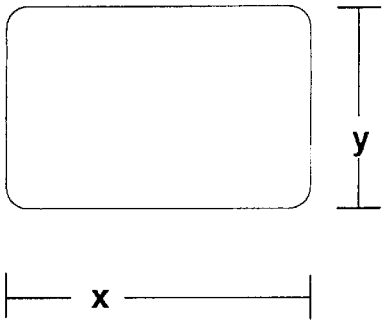
Figure 16D:
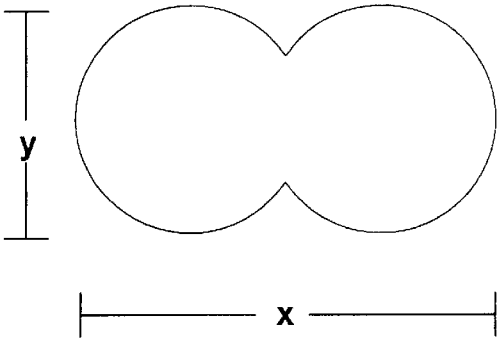

FIG. 16B illustrates a flattened yarn in which the cross section of the yarn is rectangular. In FIG. 16C, the yarn of FIG. 16B is modified slightly so that it has a rectangular cross section that includes rounded comers. In both FIGS. 16B and 16C, once again, the letter "x" designates the major axis of the cross section and the letter "y" designates the minor axis of the cross section. Finally, FIG. 16D illustrates a yarn that has a cross section formed in the shape of a "figure 8", which is sometimes referred to a "dog-bone" yarn. Such a yarn may be particularly useful in fabrics which have circular top layer CMD yarns which are stacked atop of flattened bottom layer CMD yarns, as the top layer CMD yarns can nest in the trough of the figure 8-shaped bottom CMD yarns. The designations "x" and "y" are again used to designate the major and minor axis of the yarn in FIG. 16D. In light of the examplary yarns depicted in FIGS. 16A–16D, it will be appreciated that herein by the term "flattened yarn" it is meant a yarn that has a cross section which is other than circular. The major and minor axis for such yarns should be computed consistent with the examples given above for the yarns of FIGS. 16A–16D.

Figure 2:
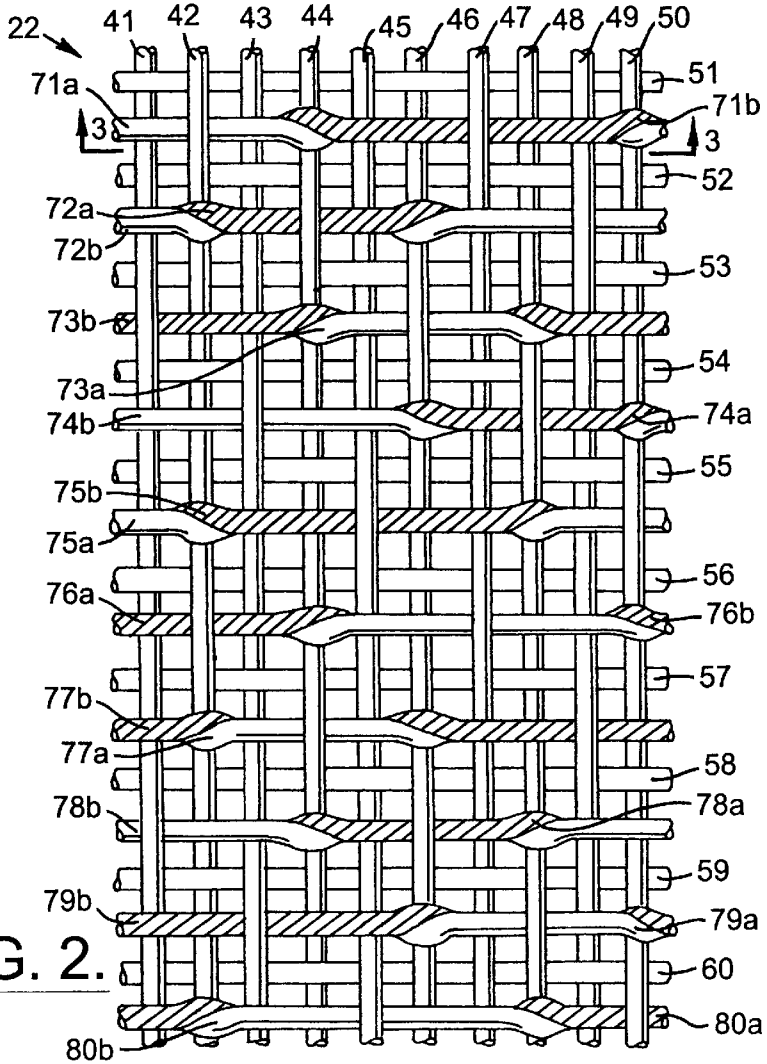
FIG. 2 is a top view of the bottom fabric layer of the triple layer forming fabric of FIG. 1.
Figure 1:
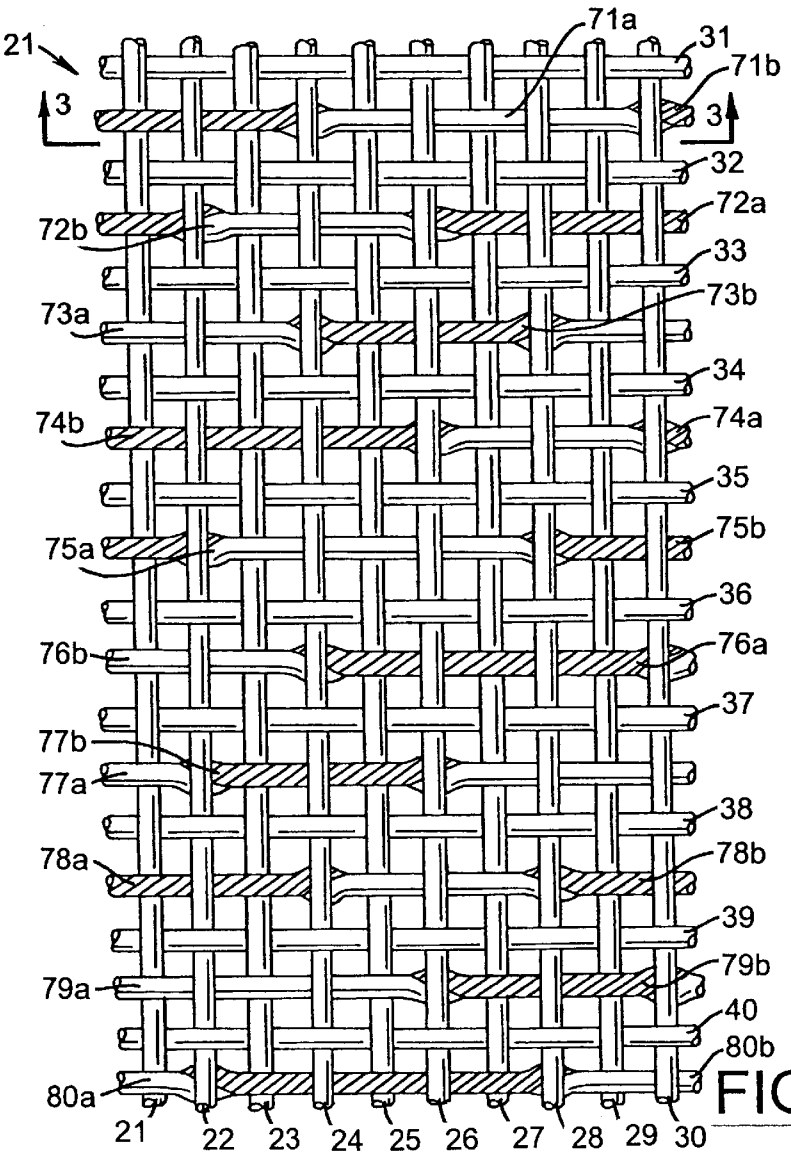
FIG. 1 is a top view of the top fabric layer of an embodiment of a 20 harness triple layer forming fabric of the present invention having a plain weave top surface.

In one embodiment of the triple layer forming fabrics of the present invention, pairs of adjacent stitching yarns are provided that are woven into the fabric such that when the first yarn of the pair is weaving in the top fabric layer the second yarn of the pair is passing downwards from the top fabric layer to interweave with the bottom fabric layer. Preferably, such pairs of stitching yarns are provided between every, or every other, pair of adjacent top layer cross machine direction yarns One such triple layer forming fabric 20 is illustrated in FIGS. 1 and 2. FIG. 1 depicts a top view of the top fabric layer 21 of fabric 20 (i.e., a view looking down onto the papermaking surface) while FIG. 2 depicts a top view of the bottom fabric layer 22 of fabric 20 which underlies the top fabric layer depicted in FIG. 1 (i.e., a view looking at the top of the bottom fabric layer 22 with the top fabric layer 21 removed). The triple layer fabric of FIGS. 1 and 2 is woven on 20 harnesses, and hence a single repeat of the fabric encompasses ten top layer machine direction yarns and ten bottom layer machine direction yarns. While FIGS. 1 and 2 only show a single repeat unit of the fabric, those of skill in the art will appreciate that in commercial applications the repeat unit shown in FIGS. 1 and 2 would be repeated many times, in both the machine and cross machine directions, to form a large fabric suitable for use on a papermaking machine.

As seen in FIG. 1, the repeat unit of the fabric 20 includes a set of top layer MD yarns 21–30 and a set of top layer CMD yarns 31–40. These yarns 21–30 and 31–40 are interwoven such that each yarn in the set of top layer CMD yarns 31–40 passes over and beneath the yarns in the set of top layer MD yarns 21–30 in an alternating fashion, with each yarn in the set of top layer CMD yarns 31–40 passing over and under the same top MD yarns. For example, top CMD yarn 31 passes under top MD yarn 21, over top MD yarn 22, under top MD yarn 23, over top MD yarn 24 and so on until it passes over top MD yarn 30. Similarly, top CMD yarn 32 passes under top MD yarn 21, over top MD yarn 22, under top MD yarn 23, over top MD yarn 24 and so on until it passes over top MD yarn 30.

Referring now to FIG. 2, a repeat unit of the bottom fabric layer 22 of the fabric 20 is shown. The repeat unit includes a set of bottom layer MD yarns 41–50 which are interwoven with a set of flattened bottom layer CMD yarns 51–60. In the example of FIG. 2, the yarns comprising the set of bottom layer CMD yarns 51–60 have a flattened cross section (although this is not readily apparent from FIG. 2 as it shows a top view of these yarns), and are interwoven with the set of bottom layer MD yarns 41–50 so that the major axis of the yarns cross section is in the same plane as the top layer 21 of the fabric 20. In FIG. 2, the sets of bottom layer MD yarns 41–50 and bottom layer CMD yarns 51–60 are interwoven in a 1×4 twill type pattern, meaning that each of the bottom layer CMD yarns 51–60 pass above one yarn of the set of bottom MD yarns 41–50, below the next four yarns of the set of bottom MD yarns 41–50, above the next yarn of the set of bottom MD yarns 41–50, and below the next four yarns of the set of bottom MD yarns 41–50. For example, bottom CMD yarn 51 passes above bottom MD yarn 41, below bottom MD yarns 42–45, above bottom MD yarn 46, and below bottom MD yarns 47 through 50. The other flattened bottom CMD yarns 52–60 follow a similar "over-one/under-four" weave pattern, although this pattern is offset by two bottom layer MD yarns for adjacent bottom CMD yarns 51–60. Thus, for example, bottom CMD yarn 52 passes above bottom MD yarns 43 and 48, whereas adjacent bottom CMD yarn 53 passes above bottom MD yarns 45 and 50.

The top fabric layer 21 (pictured in FIG. 1) and the bottom fabric layer 22 (pictured in FIG. 2) are stitched together with twenty stitching yarns, designated herein as pairs 71*a*, 71*b* through 80*a*, 80*b*. These stitching yarns are positioned in pairs between adjacent yarns of the sets of top and bottom CMD yarns 31–40 and 51–60. For example, stitching yarn pair 71*a*, 71*b* are positioned between top CMD yarns 31 and 32 and between bottom CMD yarns 51 and 52. The stitching yarns interweave with the top MD yarns and bottom MD yarns to bind the top fabric layer 21 and the bottom fabric layer 22 together.

Figure 3:
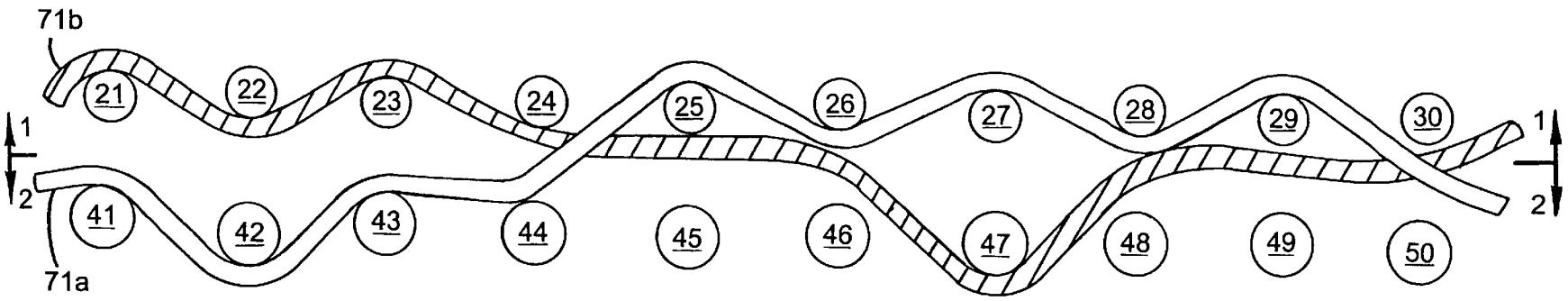
FIG. 3 is a cross-section view of the triple layer fabric depicted in FIGS. 1 and 2 taken along the line 3—3.

FIG. 3 is a cross section taken along the line 3—3 of FIGS. 1 and 2 which shows a pair of stitching yarns interweaving with the top MD yarns and bottom MD yarns. Each of the stitching yarns of the repeat unit can be subdivided into two portions: a fiber support portion which interweaves with the top MD yarns, and a binding portion which interweaves with a bottom MD yarn. These fiber support and binding portions are separated at "transitional" top MD yarns (such as top MD yarn 24 in FIG. 3), below which one stitching yarn of a pair crosses the other stitching yarn of the pair. The stitching yarns of each pair are interwoven relative to one another such that the fiber support portion of one yarn of the pair is positioned above the binding portion of the other yarn of the pair. In the repeat pattern shown in FIGS. 1–3, one of the yarns (e.g., yarn 71*a*) of each pair of stitching yarns includes a fiber support portion which interweaves in an alternating fashion with five top MD yarns (yarns 25–29 in the case of yarn 71*a*), alternately passing over three top MD yarns (yarns 25, 27, 29) and under two top MD yarns (yarns 26, 28). The other stitching yarn of the pair (yarn 71*b*) likewise has a fiber support portion which passes over two top MD yarns (yarns 21, 23) while passing below a top MD yarn (yarn 22) positioned between those two MD yarns. As shown in FIG. 3, there are two transitional top MD yarns 24, 30 in the repeat, which, as noted above, refer to a top layer MD yarn beneath which the yarns of a pair of stitching yarns cross.

As best seen in FIG. 1, in its fiber support portion, each pair of stitching yarns collectively pass over the top layer MD yarns 21–30 that the top layer CMD yarns 31–40 which are adjacent to the pair of stitching yarns pass beneath, and pass below the top layer MD yarns that each adjacent top layer CMD yarn pass over. In this manner, the stitching yarns 71*a*–80*a* and 71*b* –80*b* (which as a pair weave as the equivalent of a single yarn on the papermaking surface) and top layer CMD yarns 31–40 form a plain weave pattern with the top layer MD yarns 21–30.

As can also be seen in FIG. 3, in its binding portion, stitching yarn 71*a* passes below top layer MD yarns 21–23 while passing above bottom layer MD yarns 41 and 43 and below bottom layer MD yarn 42 to stitch the bottom layer 22 of the fabric 20. Stitching yarn 71*a* then passes beneath the transitional top layer MD yarn 24 and over bottom layer MD yarn 44. Similarly, stitching yarn 71*b* also has a binding portion which passes below top layer MD yarns 25–29 while passing above bottom layer MD yarns 45–46 and 48–49 and below bottom layer MD yarn 47 to stitch the bottom layer 22 of the fabric 20. As shown in FIG. 3, when the stitching yarn 71*a* is weaving in the top fabric layer 21 (i.e., in its fiber support portion), stitching yarn 71*b* is passing downwards from the top fabric layer 21 to interweave with the bottom fabric layer 22 (i.e., in its binding portion).

As shown in FIG. 1, top layer CMD yarns 31–40, stitching yarns 71*a*–80*a* and 71*b*–80*b* and top layer MD yarns 21–30 combine to form a top surface with the "over-one/under-one" pattern of a plain weave on the top layer 21. Additionally, as shown in FIG. 2, the flattened bottom CMD yarns 51–60 and the bottom layer MD yarns 41–50 combine to form an "over-one/under-four" pattern on the bottom surface of the fabric 20.

Cross sections similar to the cross section of FIG. 3 may be drawn for each of the remaining pairs of stitching yarns. As is apparent from FIGS. 1 and 2, the stitching yarns in each of these cross sections would follow the same weave pattern as stitching yarns 71*a* and 71*b* in FIG. 3. However, as shown in FIGS. 1 and 2, pairs of stitching yarns that are positioned adjacent to and on opposite sides of a top CMD yarn are interwoven with the top or bottom MD yarns such that there is an offset of two MD yarns between such stitching yarn pairs. For example, stitching yarn 71*a* passes above top MD yarns 25, 27 and 29 and below bottom MD yarn 42. Stitching yarn 72*a* passes above top MD yarns 27, 29 and 21 (with top MD yarn 21 being, a continuation of the pattern on the opposite side) and below bottom MD yarn 44. Thus, stitching yarn 71*a* is offset from stitching yarn 72*a* by two top and two bottom MD yarns. This same two MD yarn offset is followed for the interweaving of the other stitching yarns.

In one embodiment of the fabric depicted in FIGS. 1–3, both the top machine direction yarns and the top cross machine direction yarns are 0.15 mm in diameter, while the stitching cross machine direction yarns are 0.13 mm in diameter. The bottom machine direction yarns are 0.20 mm in diameter, and the flattened bottom CMD yarns have a major axis of 0.20 mm and a minor axis of 0.15 mm. This fabric may be implemented with nylon or polyester yarns, or with a combination thereof.

Figure 5:
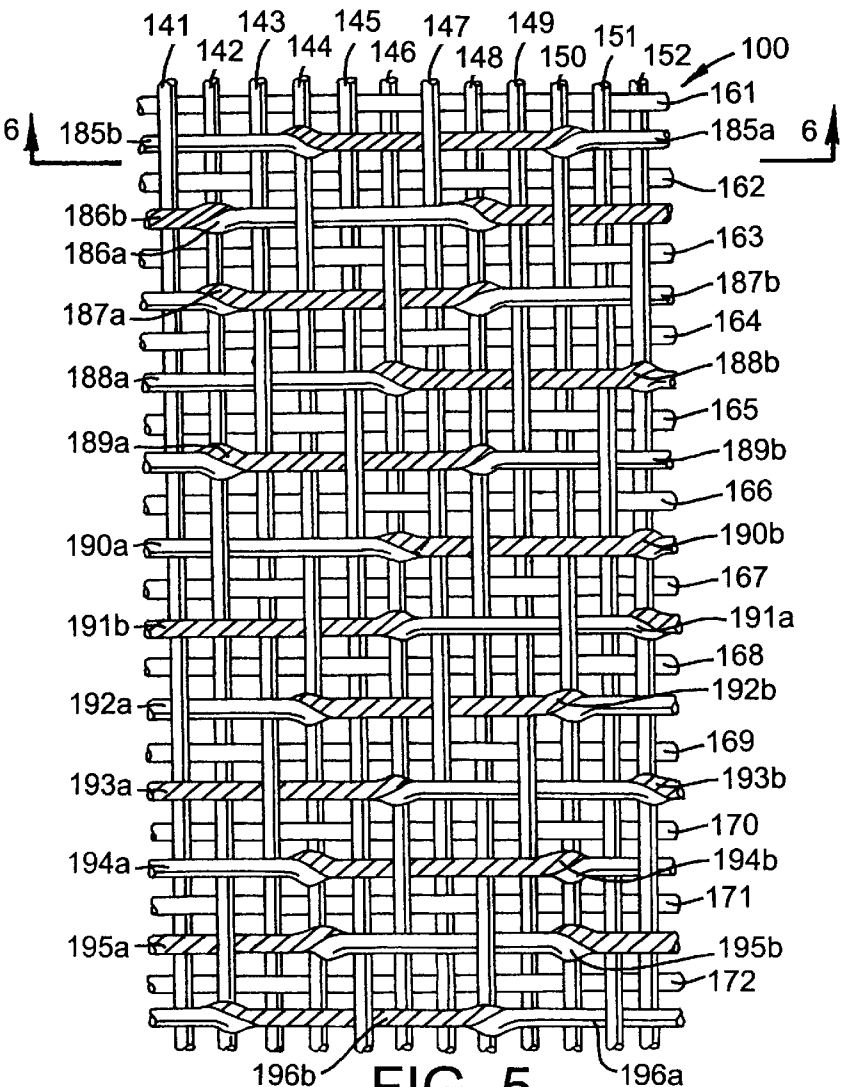
FIG. 5 is a top view of the bottom fabric layer of the fabric of FIG. 4.
Figure 4:
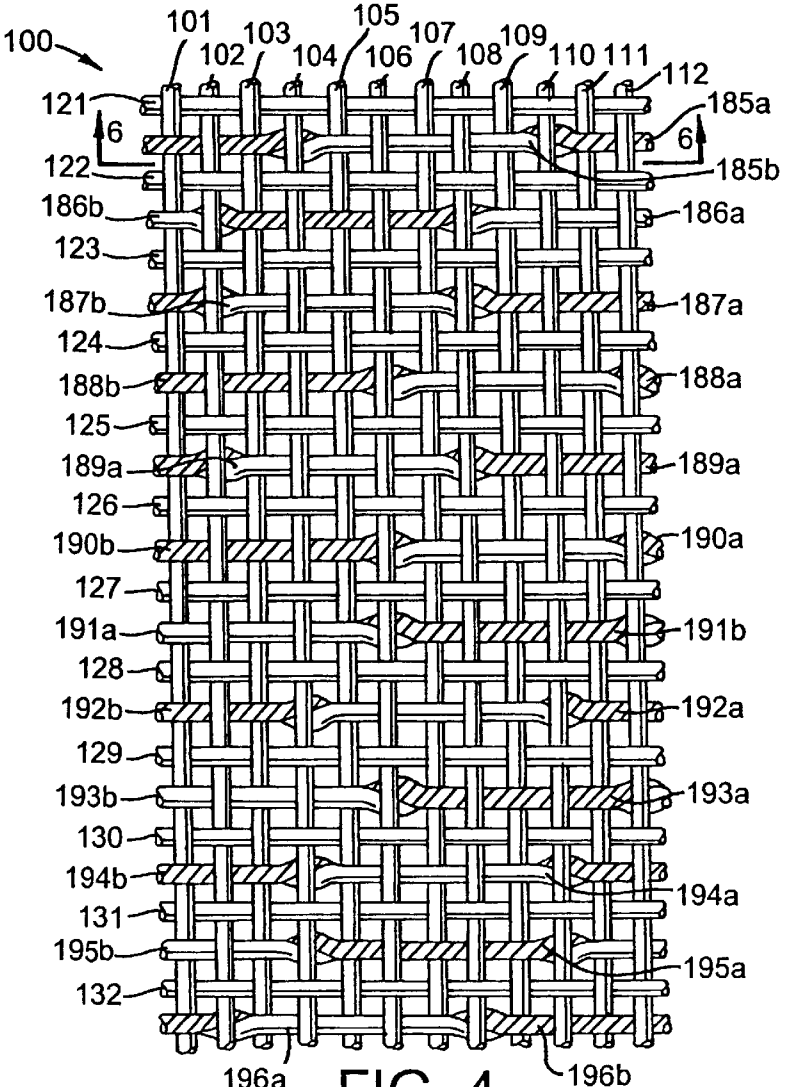
FIG. 4 is a top view of an embodiment of a 24 harness multi-layer forming fabric of the present invention having a plain weave top surface.
Figure 6:
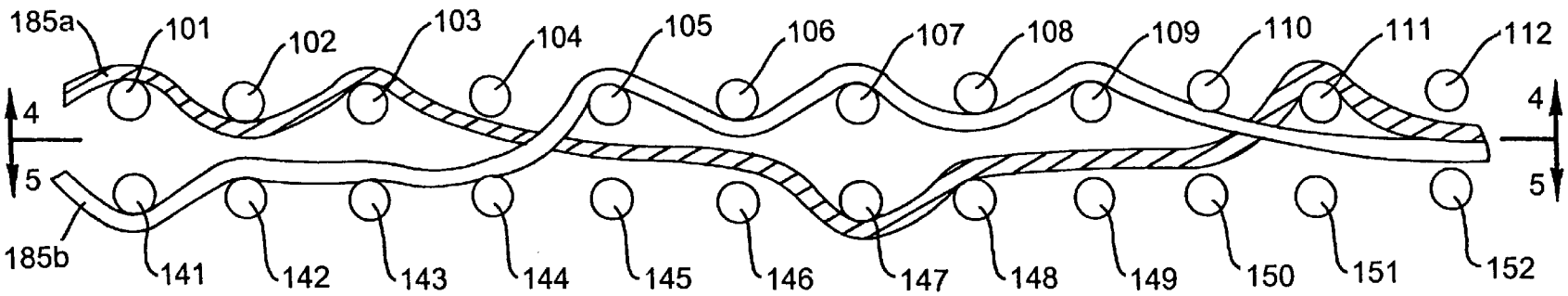
FIG. 6 is a cross-section view of the triple layer fabric depicted in FIGS. 4 and 5 taken along the line 6—6.

Another embodiment of the present invention is illustrated in FIGS. 4, 5 and 6, wherein a repeat unit of a 24 harness multi-layer forming, fabric designated broadly as 100 is shown. The fabric 100 comprises a set of top layer machine direction yarns 101–112, top layer CMD yarns 121–132, a set of bottom layer MD yarns 141–152, a set of flattened bottom CMD yarns 161–172, and stitching yarns 185*a*, 185*b* through 196*a*, 196*b*. One pair of stitching yarns is positioned between adjacent top layer CMD yarns and adjacent flattened bottom CMD yarns.

Like the fabric 20, the top MD and CMD yarns of the fabric 100 are interwoven such that each top CMD yarn passes over and under alternate MD yarns, and so that every top CMD yarn passes over and under the same MD yarns. These, in combination with the stitching yarn pairs, form a top papermaking surface that has a plain weave pattern (FIG. 4). The bottom MD yarns 141–152 are interwoven with the flattened bottom CMD yarns 161–172 so that each bottom CMD yarn follows an "over-one/under-five" pattern relative to the bottom MD yarns. As also shown in FIG. 5, the knuckles formed by the bottom MD yarns take a "broken twill" pattern, in which the knuckles formed under adjacent CMD yarns are first offset by two MD yarns in one direction, then by three MD yarns in the opposite direction. Thus, the knuckles form a zig-zag diagonal pattern.

Each of the stitching yarns of the fabric 100 has a fiber support portion, which interweaves with the top MD yarns, and a binding portion, which stitches with the bottom layer of the fabric 100. As in the fabric 20 these portions of the stitching yarns are separated at transitional top MD yarns, under which both stitching yarns of a pair pass under and cross. The fiber support portion of each stitching yarn is positioned above the binding portion of the other stitching yarn of its pair. FIG. 6 illustrates the weave pattern for stitching yarn pair 185*a*, 185*b*.

As shown in FIG. 6, in a repeat each of the stitching yarns 185*a*, 185*b* have a fiber support portion in which they interweave with five top layer MD yarns in an over-one/under-one/over-one/under-one/over-one pattern. Each of the remaining stitching yarns of the fabric 100 follows this same weave pattern in its fiber support portion, such that each stitching yarn passes over three top MD yarns and under two top MD yarns in an alternating fashion in each repeat of the fabric. As best seen in FIG. 4, the stitching yarns pass over the top MD yarns 101–111 passed under by the top CMD yarns 121–132, then pass over the top MD yarns 101–111 passed under by the top CMD yarns 121–132, with the result that the top layer of the fabric 100 has a plain weave surface. Pairs of stitching yarns are interwoven with the top MD yarns such that each group of four adjacent stitching yarn pairs falls within a pattern in which the fiber support portions of three of the four pairs of stitching yarns are not offset from one another in the MD direction at all; i.e., the fiber support portions of each pass over the same top MD yarns. The fiber support portion of the fourth pair of stitching yarns of the group is offset from the others within the group by two top MD yarns. For the fiber support portions of the next group of four yarn pairs, the entire group is offset by two top MD yarns in the direction opposite of the offset of the individual stitching yarn pair.

As an example of this pattern, the stitching yarns 192*a*, 193*a*, 194*a*, and 195*a* form a group of four stitching yarns in adjacent stitching yarn pairs. Of these, stitching yarns 192*a*, 194*a*, and 195*a* pass over top MD yarns 105, 107 and 109. Stitching yarn 193*a* passes over top MD yarns 107, 109, and 111, which represents a two MD yarn offset. The next group of four stitching yarn pairs would then begin with stitching yarn 195*a*, which passes over top MD yarns 103, 105 and 107; this represents a two top MD yarn offset in the direction opposite that of the offset of stitching yarn 193*a*. This pattern continues for each group of four stitching yarn pairs.

As best seen in FIG. 6, in its binding portion, each stitching yarn (e.g., 185*a*, 185*b*) passes below five top MD yarns and above four bottom MD yarns while passing below one bottom MD yarn to stitch the top and bottom layers together. The bottom MD yarn stitched by the stitching yarn binding portion follows one of three different patterns; it is either the second, third or fourth bottom MD yarn reached by the stitching yarn after passing below a transitional top MD yarn. For example, stitching yarn 185*a* passes below bottom MD yarn 147, the third bottom MD yarn it approaches after passing below transitional top MD yarn 104. In contrast, as best seen in FIG. 5, stitching yarn 186*a* passes below bottom MD yarn 144, the second bottom MD yarn it approaches after passing below transitional top yarn 102, and stitching yarn 187*a* passes below bottom MD yarn 146, the fourth bottom MD yarn it approaches after passing below transitional top MD yarn 102.

As shown in FIG. 5, the stitching yarns of each pair follow the same weave pattern in their binding portions as the other stitching yarn of that pair (i.e., like stitching yarn 187*a*, stitching yarn 187*b* also stitches the fourth bottom MD yarn it approaches after passing below a transitional top MD yarn). Also, it can be seen from FIG. 5 that the stitching yarn pairs follow a pattern in which the stitching yarns of the first pair stitch the third bottom MD yarn they approach, the stitching yarns of the second pair stitch the second bottom MD yarn they approach, the stitching yarns of the third pair stitch the fourth bottom MD yarn they approach, and the stitching yarns of the fourth pair stitch the third bottom MD yarn they approach. This "third/second/fourth/third" pattern is repeated three times within the repeat unit.

Those skilled in this art will also appreciate that other plain weave patterns in which the stitching yarns are divided differently into fiber support portions and binding portions can be constructed. For example, the fabric can include a top layer in which each stitching yarn of a pair passes over two or four top MD yarns in its fiber support portion (instead of three top layer MD yarns as in the example of FIGS. 4 and 6). As illustrated in FIG. 1, the stitching yarns can pass over different numbers of top MD yarns, or can pass over the same number. Of course, appropriate adjustment of the positioning of the bottom knuckles in the binding portions of such stitching yarns should be made with changes to the stitching yarn pattern on the top surface.

Figure 7:
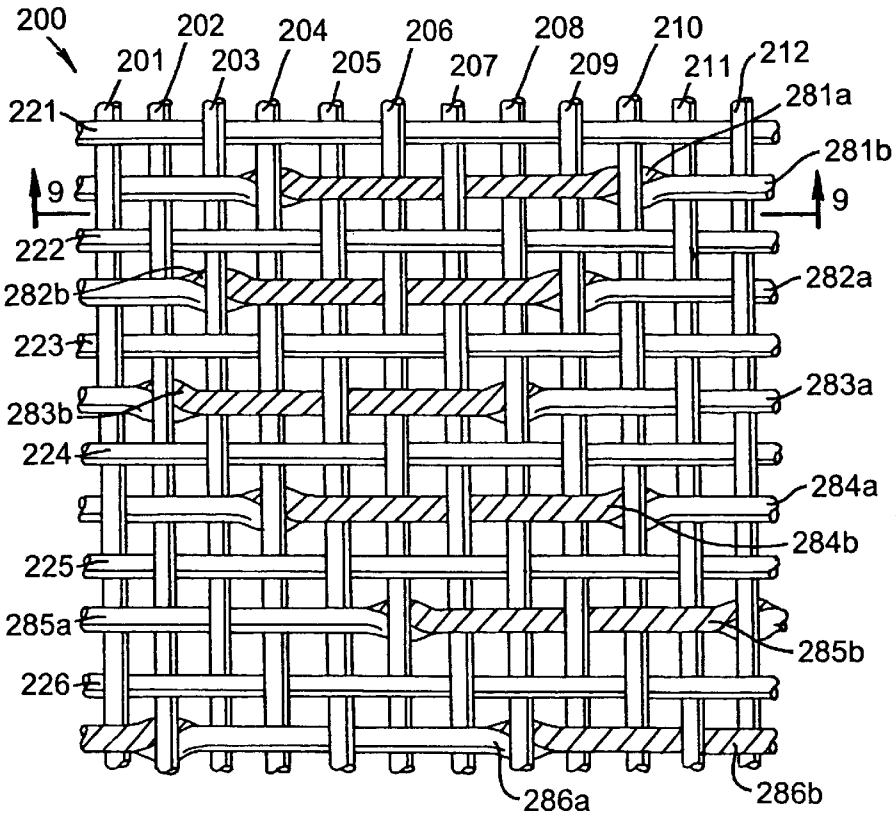
FIG. 7 is a top view of a 24 harness triple layer forming fabric of the present invention having a top surface with a 1×2 weave pattern.

Those of skill in the art will also appreciate that fabrics similar to the illustrative fabrics of FIGS. 1–3 and FIGS. 4–6 may be constructed that have a papermaking surface other than a plain weave surface. For instance, as disclosed in FIGS. 7, 8 and 9, a multi-layer forming fabric 200 in which the papermaking surface is woven in a 1×2 broken twill pattern may be provided. As shown in FIG. 7, the repeat unit includes 12 top layer MD yarns 201–212, 6 top layer CMD yarns 221 through 226, 12 bottom layer MD yarns 241–252, 6 bottom layer CMD yarns 261–266, and 12 stitching yarns 281*a*, 281*b* through 286*a*, 286*b*.

As shown in FIG. 7, the top surface of the fabric 200 has a 1×2 twill pattern formed by the set of top layer MD yarns, the set of top layer CMD yarns and the fiber support portions of the stitching yarns. More specifically, each top layer CMD yarn interweaves with the top MD yarns in an "over-two/under-one" pattern; this is demonstrated by top CMD yarn 221, which passes over top MD yarns 201 and 202, under top MD yarn 203, over top MD yarns 204, 205, under top MD yarn 206, over top MD yarns 207, 208, under top MD yarn 209, over top MD yarns 210, 211, and under top MD yarn 212. The remaining top CMD yarns follow the same "overtwo/under-one" pattern, but are laterally offset from their adjacent CMD yarns by two MD yarns. For example, top CMD yarn 222 passes over top MD yarn 201, under top MD yarn 202, over top MD yarn 203 and 204, and under top MD yarn 205 before continuing in an over-two-under-one pattern. Thus, the "over-two" portion of top CMD yarn 222 is first seen as it passes over top MD yarns 203 and 204, which are offset from the top MD yarns 201, 202 passed over by top CMD yarn 221 by two MD yarns.

Figure 8:
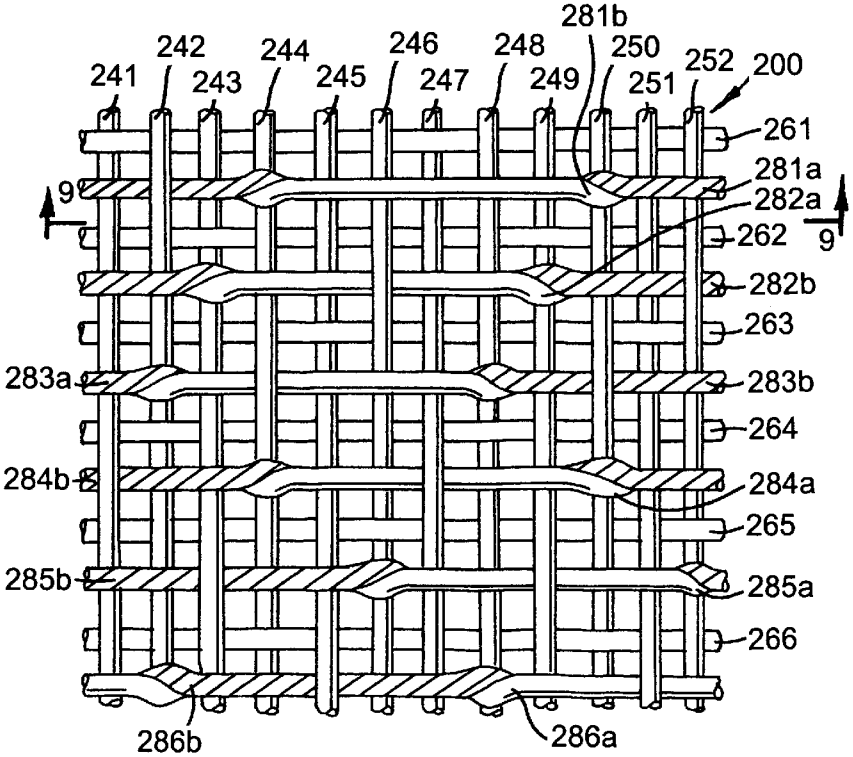
FIG. 8 is a top view of the bottom fabric layer of the fabric of FIG. 7.

Referring now to FIG. 8, the upper surface of the bottom layer of fabric 200 is depicted. The bottom layer CMD yarns 261–266 have a flattened cross section (although this is not readily apparent from FIG. 8 as it shows a top view of these yarns), with their major axis in the plane parallel with the papermaking surface, thereby reducing the caliper of the fabric (as compared to a fabric with circular yarns of the same weight). As is also depicted in FIG. 8, the flattened bottom CMD yarns and the bottom MD yarns are woven in the pattern of a "broken twill." Each bottom layer CMD yarn has an "under-five/over-one" repeat pattern with the bottom layer MD yarns. For example, bottom CMD yarn 261 passes over bottom layer MD yarn 241, under bottom layer MD yarns 242 through 246, over bottom layer MD yarn 247, and under bottom layer MD yarns 248 through 252. This "under-five/over-one" pattern is repeated by the remaining bottom CMD yarns. However, the machine side knuckles formed by the bottom layer MD yarns as they pass below the flattened bottom CMD yarns are arranged in a broken twill pattern which fail to form a clear diagonal as is characteristic of twill fabrics.

The top and bottom layers of the fabric 200 are bound together by the stitching yarns listed above, each of which has both a fiber support portion and a binding portion. As with the fabrics 20 and 100 described earlier, the fiber support portion and binding portion of each stitching yarn are divided by transitional top layer MD yarns below which stitching yarns of a pair cross each other. The fiber support portion of each stitching yarn follows an "over-two/under-one/over-two" pattern. In its binding portion, each stitching yarn passes between the top and bottom layer MD yarns with the exception of passing below one bottom layer MD yarn to stitch the top and bottom layers together. The bottom layer MD yarn that is stitched is located either two or three MD yarns away from the transitional MD yarns that separate the fiber support and binding portions of each stitching yarn.

Figure 9:
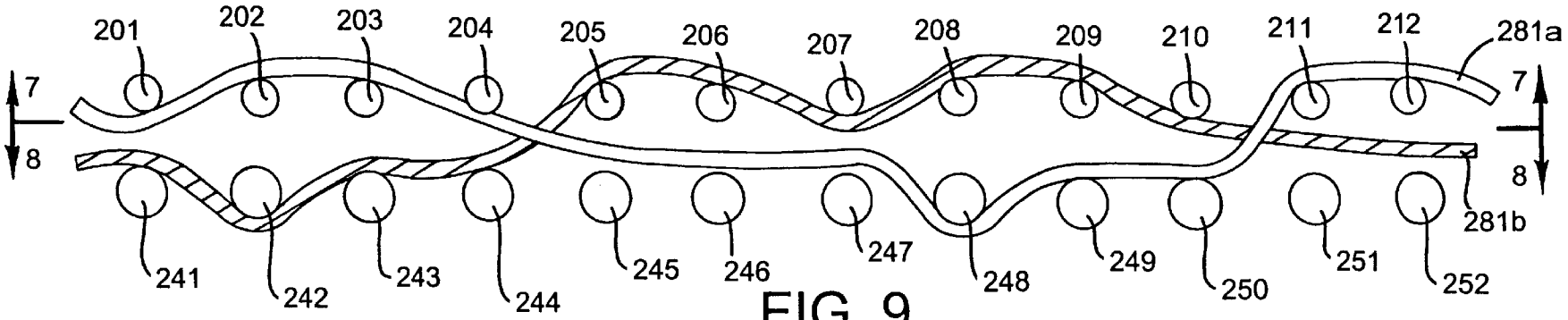
FIG. 9 is a cross-section view of the triple layer fabric depicted in FIGS. 7 and 8 taken along the line 9—9.

This pattern is exemplified by stitching yarn 281*b*, the stitching pattern of which is illustrated in FIG. 9. Stitching yarn 281*b* passes over top layer MD yarns 205 and 206, under top layer MD yarn 207, and over top layer MD yarns 208, 209 before passing below transitional top layer MD yarn 210. In its binding portion, stitching yarn 281*b* passes above bottom layer MD yarns 251, 252 and 241, below bottom layer MD yarn 242 and above bottom layer MD yarn 243 before passing below transitional top layer MD yarn 204 and above bottom layer MD yarn 244. The pairs of stitching yarns are interwoven with the top layer MD yarns relative to one another such that their fiber support portions, the top layer MD yarns, and the top layer CMD yarns form a 1×2 twill pattern.

FIG. 7 demonstrates that the stitching yarns are interwoven with the top and bottom layer MD yarns relative to top layer CMD yarns such that an "over-two" segment of each fiber support portion is offset by one MD yarn from an "over-two" segment of the top layer CMD yarns that flank that stitching yarn. For example, the stitching yarn 281*b* passes over top layer MD yarns 202 and 203. The nearest top CMD yarns, which are 221 and 222, pass over top MD yarns 201, 202 and 203, 204, respectively. Thus, the distinctive diagonal of a twill is formed by the top layer CMD yarns and the fiber support portions of the stitching yarns.

FIG. 8 also illustrates how the stitching yarns are stitched into the bottom layer MD yarns. It can be seen in FIG. 8 that the knuckle formed by each stitching yarn as it passes below a bottom layer MD yarn is positioned such that, in one direction, two flattened bottom CMD yarns reside between the stitching yarn knuckle and the knuckle formed by that bottom layer MD yarn under a flattened bottom CMD yarn, and in the opposite direction, three flattened bottom CMD yarns reside between the stitching yarn knuckle and the next knuckle formed by that bottom layer MD yarn under over a flattened bottom CMD yarn. For example, stitching yarn 284*b* forms a knuckle as it passes under bottom layer MD yarn 241. The bottom layer MD yarn 241 forms a knuckle as it passes under flattened bottom CMD yarn 261, which is separated from the knuckle formed by stitching yarn 284*b* by three flattened bottom CMD yarns (262, 263, 264). Continuing with the pattern in the other direction, flattened bottom CMD yarns 265 and 266 are positioned between the knuckle formed by stitching yarn 284*b* and the knuckle that would be formed by bottom MD yarn 241 under the next flattened bottom CMD yarn after flattened bottom CMD yarn 266 (which would have the same weave pattern as flattened bottom CMD yarn 261). Thus, the stitching yarn knuckle of stitching yarn 284*b* is separated from bottom layer MD yarn knuckles by three flattened bottom CMD yarns in one direction and by two flattened bottom CMD yarns in the other direction.

Those skilled in this art will appreciate that fabrics of the present invention can be constructed with other twill patterns in the top layer. For example, a fabric can have a 1×3 or 1×4 twill top layer. Any of these twill patterns can be a conventional twill, or can take a broken twill pattern, such as those embodied in 4 or 5 harness satin single layer fabrics. Fabrics can also be constructed in which fiber support portions of stitching yarn pairs pass over different numbers of top MD yarns. In each instance, the skilled artisan should understand the appropriate modifications to the binding portions of the stitching yarns to accommodate differences in the fiber support portions.

Note that in the fabrics 20, 100 and 200 illustrated in FIGS. 1, 4 and 7, respectively, the combination of the set of top layer MD yarns, the set of top layer CMD yarns, and the set of stitching CMD yarns, forms a papermaking surface having single float machine direction knuckles. By "single float machine direction knuckles" it is meant that on the papermaking surface no machine direction yarn passes over more than one consecutive cross machine direction yarn before passing back down below the top surface of the fabric. In a preferred embodiment of the triple layer forming fabrics of the present invention, the top MD yarns, top CMD yarns, and stitching CMD yarns form a papermaking surface having such single float machine direction knuckles. However, as will be apparent from the discussion below, a papermaking surface having such single float machine direction knuckles is not required, and in fact, with respect to some weave patterns, it may instead be preferable to provide a top fabric layer wherein the combination of just the top MD yarns and top CMD yarns results in a fabric having single float machine direction knuckles, but if the stitching yarns are also considered, the top fabric layer includes some double float machine direction knuckles (see, e.g., FIG. 11 herein).

In the fabrics depicted in FIGS. 1–9 above, pairs of stitching yarns were generally used to "complete" a particular weave pattern on the papermaking surface. Thus, for example, in FIG. 1, stitching yarns 61*a*–70*a* and 61*b*–70*b* completed an over-one/under-one or "plain weave" pattern on the papermaking surface of the fabric, and in FIG. 7 the stitching yarns 281*a*–286*a* and 281*b*–286*b* completed a 1×2 twill pattern. However, in light of the discussion below, those of skill in the art will appreciate that flattened bottom CMD yarns may advantageously be used to provide a variety of other low caliper multi-layered fabrics in which the stitching yarns do not complete a particular weave pattern on the papermaking surface.

Figure 11:
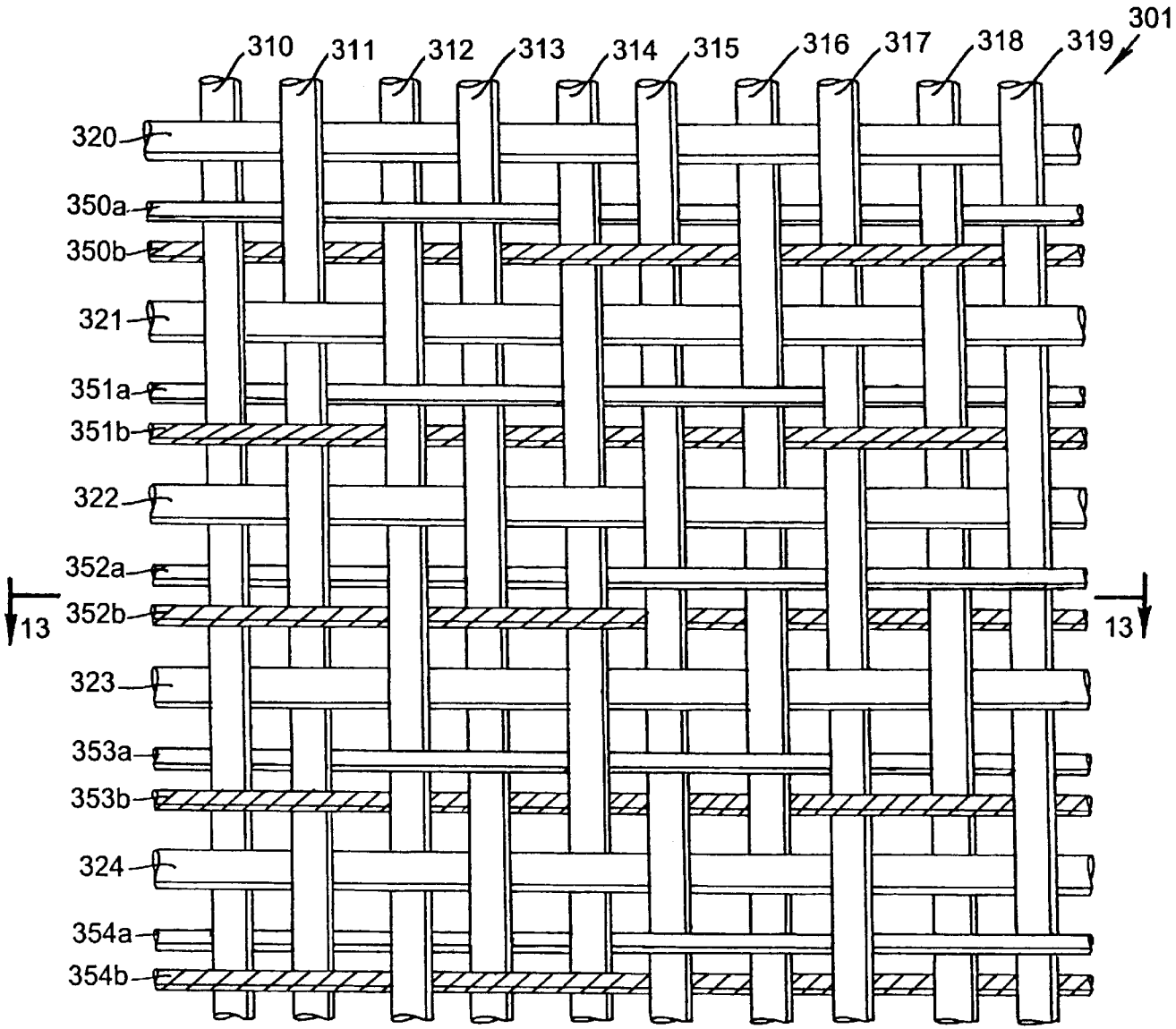
FIG. 11 is a top view of the top fabric layer of an embodiment of a triple layer forming fabric of the present invention having pairs of stitching yarns that serve as both fiber support and locator yarns.
Figure 12:
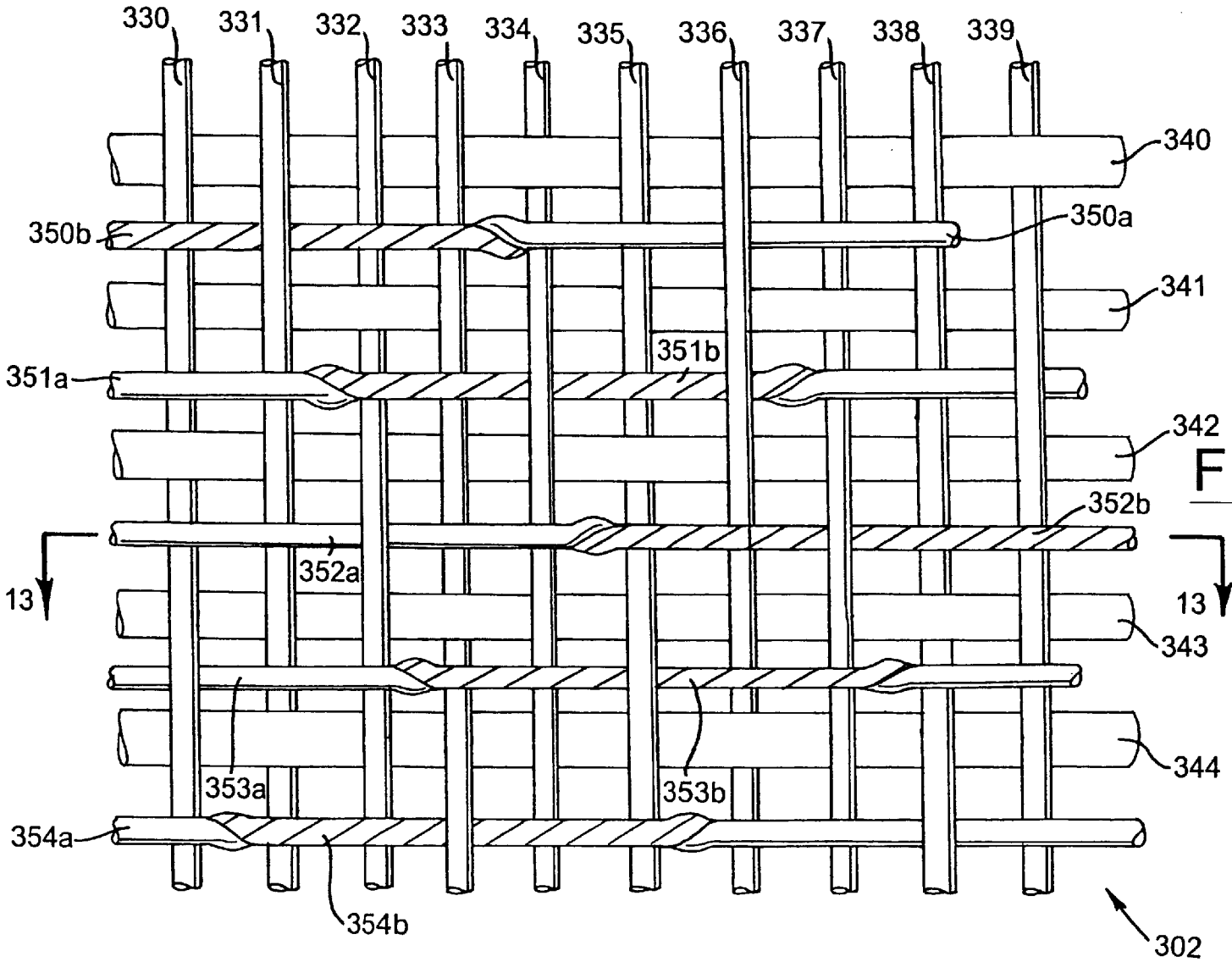
FIG. 12 is a top view of the bottom fabric layer of the triple layer forming fabric of FIG. 11.
Figure 13:
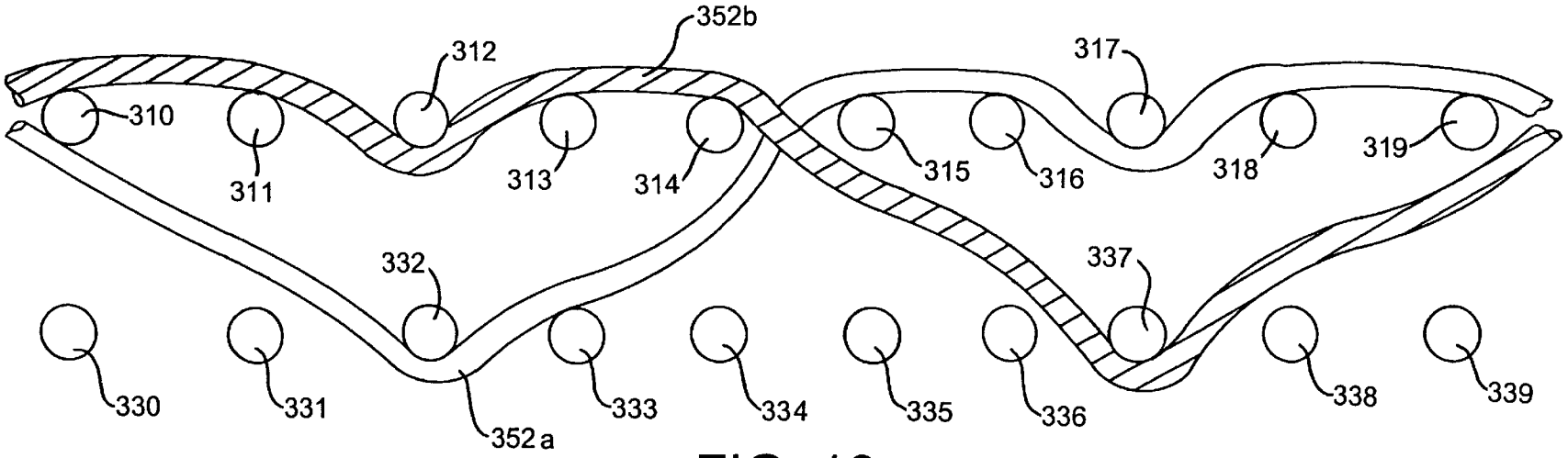
FIG. 13 is a cross-section view of the triple layer fabric depicted in FIGS. 11 and 12 taken along the line 13—13.

FIGS. 11–13 depict a portion of a triple layer embodiment of one such fabric 300. As seen in FIG. 11, which is a top view of the top fabric layer 301 of fabric 300 (i.e., a view of the papermaking surface), the top fabric layer 301 includes a set of top layer MD yarns 310–319 and a set of top layer CMD yarns 320–324. These yarns 310–319 and 320–324 are interwoven in an over-one/under-one pattern to form a plain weave base top fabric layer. Thus, for example, top CMD yarn 321 passes under top MD yarn 310, over top MD yarn 311, under top MD yarn 312, over top MD yarn 313 and so on until it passes over top MD yarn 319. Those of skill in the art will appreciate that FIG. 11 only depicts one repeat unit of the fabric.

Referring now to FIG. 12, the portion of the bottom layer 302 of the fabric 300 corresponding to the portion of the fabric shown in FIG. 11 is shown. As illustrated in FIG. 12, the bottom layer 302 of fabric 300 includes a set of bottom layer MD yarns 330–339 which are interwoven with a set of bottom layer CMD yarns 340–344. The yarns comprising the set of bottom layer CMD yarns 340–344 are flattened (oval), and are interwoven with their major axis in the same plane as the papermaking surface to reduce the caliper of the fabric. The bottom layer set of MD yarns 330–339 are interwoven with the flattened bottom CMD yarns 340–344 in a 1×4 twill type pattern, meaning that each of the yarns 340–344 pass above one yarn of the set of bottom MD yarns 330–339, below the next four yarns of the set of bottom MD yarns 330–339, above the next yarn of the set of bottom MD yarns 330–339, and below the next four yarns of the set of bottom MD yarns 330–339. For example, flattened bottom CMD yarn 340 passes below bottom MD yarns 330–333, above bottom MD yarn 334, below bottom MD yarns 335–338 and above bottom MD yarn 339. The other flattened bottom CMD yarns 342–344 follow a similar "underfour/over-one" weave pattern, although this pattern is offset to the left by two bottom layers MD yarns for adjacent bottom CMD yarns.

The top fabric layer 301 (pictured in FIG. 11) and the bottom fabric layer 302 (pictured in FIG. 12) are stitched together with pairs of stitching yarns, designated herein as pairs 350*a*, 350*b*; 351*a*, 351*b*; 352*a*, 352*b*; 353*a*, 353*b*; and 354*a*, 354*b*. These stitching yarn pairs are positioned between adjacent yarns of the set of top layer CMD yarns and adjacent flattened layer CMD yarns. For example, stitching yarns 350*a* and 350*b* are positioned between top CMD yarns 320 and 321 and between flattened bottom CMD yarns 340 and 341. The stitching yarns interweave with the top MD yarns and bottom MD yarns to bind the top fabric layer 301 and bottom fabric layer 302 together.

FIG. 13, which is a cross section taken along the line 13—13 of FIGS. 11 and 12 illustrates one repeat of the weave pattern followed by stitching yarns 352*a*, 352*b*. Note that each of stitching yarns 352*a* and 352*b* has a fiber support portion where it interweaves with the top MD yarns, and a binding portion where it interweaves with a bottom MD yarn. However, in this particular embodiment of the present invention, the "transitional" points where the stitching yarns stop weaving with the top MD yarns and pass down into the fabric occurs between two top MD yarns (e.g., MD yarns 314, 315 in FIG. 13) as opposed to beneath one of the top MD yarns as was the case with the fabrics illustrated, for example, in FIGS. 1–9. As is also shown in FIG. 13, the stitching yarn pairs are interwoven such that the fiber support portion of one yarn of the pair is positioned above the binding portion of the other yarn of the pair. As can be seen in FIGS. 11 and 13, one of the yarns (e.g., yarn 352*b*) of each pair of stitching yarns includes a fiber support portion where it interweaves in an alternating fashion with five top MD yarns (yarns 310–314) by passing over top MD yarns 310, 311, under top MD yarn 312, and over top MD yarns 313, 314. The other stitching yarn of the pair, yarn 352*a*, likewise has a fiber support portion in which it passes over top MD yarns 315, 316, under top MD yarn 317 and over top MD yarns 318, 319. In its binding portion, stitching yarn 352*b* passes below top layer MD yarns 315–319 while passing above bottom layer MD yarns 335, 336, 338 and 339 and below bottom layer MD yarn 337 to stitch the bottom layer 302 of the fabric 300 (see FIG. 13). Similarly, stitching yarn 352*a* also has a binding portion in which it passes below top layer MD yarns 310–314 while passing above bottom layer MD yarns 330, 331 and 333, 334 and below bottom layer MD yarn 332 to stitch the bottom layer 302 of the fabric 300. As shown in FIG. 13, the stitching yarns are woven such that when one yarn of the pair is in its binding portion the other yarn of the pair is in its fiber support portion.

The other pairs of stitching yarns illustrated in the plan views follow the same weave pattern as shown for stitching yarns 352*a* and 352*b* in the cross section view of FIG. 13. However, as shown in FIGS. 11 and 12, the pairs of stitching yarns that are positioned adjacent to and on opposite sides of a top CMD yarn preferably are interwoven with the top or bottom MD yarns such that there is an offset of one or more MD yarns between such stitching yarn pairs. In the illustrated embodiment, this offset is three MD yarns to the right. Thus, for example, the fiber support portion of stitching yarn 350*a* occurs in the vicinity of top MD yarns 310–313, and 319 while the fiber support portion of stitching yarn 351*a* occurs in the vicinity of top MD yarns 312–316. However, one of skill on the art will appreciate that a variety of different offsets may be used depending upon the number of harnesses on which the fabric is constructed and the desired papermaking qualities.

As is best illustrated in FIG. 11, each of the stitching yarns 350*a*–354*a* and 350*b*–354*b* serves both a fiber support function and a locator function. By "fiber support function"

it is meant that the yarn weaves with the top fabric layer 301 of the fabric 300 so as to provide support to the paper slurry fibers during the papermaking process. By "locator function" it is meant that the yarn exerts a force on the other stitching yarn at the transition point so as to urge the other stitching yarn towards its proper position, which typically is midway between adjacent top cross machine direction yarns. In a preferred embodiment, the stitching yarns are either approximately the same diameter as the top fabric layer cross machine direction yarns, or are slightly (e.g., 35% smaller) than the top fabric layer CMD yarns.

One method of implementing the locator function can be seen in FIG. 11 at the transition points where each of the pairs of stitching CMD yarns cross each other entering and leaving the top fabric surface. Focusing on stitching yarns 351*a*, 351*b*, one such transition point occurs between top layer MD yarns 311, 312. At that point, top MD yarn 312 has just crossed over top CMD yarn 321 and passes under the top CMD yarn 322; consequently, top MD yarn has a downward slope as it travels between top CMD yarns 321 and 322. Similarly, top MD yarn 311 has just passed under top CMD yarn 321 and over top CMD yarn 322. Thus, top MD yarn 311 has an "uphill" slope as it travels between top CMD yarns 321 and 322. Because top MD yarn 312 is on a "downhill" slope at the aforementioned transition point, it applies a force to stitching yarn 351*a* towards top CMD yarn 322. Consequently, at the transition point, stitching yarn 351*a* would tend to "pair" with top CMD yarn 322 in the absence of a countervailing force. Similarly, since top MD yarn 311 is on an uphill slope at this transition point, it applies a force to stitching yarn 351*b* which (in the absence of a countervailing force) urges yarn 351*b* to pair with top CMD yarn 321. However, since at the transition point the top MD yarns 311, 312 are urging stitching yarns 351*a*, 351*b* in opposite directions with substantially equal forces, stitching yarns 351*a*, 351*b* apply generally opposite forces on each other, which tends to maintain the yarns in a central position between top CMD yarns 321, 322 at the transition point.

As is best illustrated in FIG. 13, in a preferred embodiment of the present invention the stitching yarns are woven into the fabric in pairs. Moreover, these stitching yarns may advantageously be woven in the same weave pattern, except that they are offset by some number of top MD yarns, so that when one of the stitching yarns is performing a fiber support function the other of stitching yarn of the pair is performing a binding function. Preferably, the combined weave of the top layer MD yarns, the top layer CMD yarns and the stitching yarns is such that each yarn of a pair of stitching yarns exerts a force on the other yarn at the crossover or "transition" points as described above so as to help locate the yarn in its proper position in the fabric. Moreover, while those of skill in the art will appreciate that it generally is preferable to have such a locating function occur at every transition point, the fabric may also be woven such that the locating function only occurs at some of the transition points.

In fabric 300 (see FIG. 11), the set of top layer MD yarns and the set of top layer CMD yarns form a fabric having single float machine direction knuckles (i.e., no machine direction yarn passes over more than one of the top layer cross machine direction yarns 320–324 before passing back down below the surface of the fabric). This results in a papermaking surface which largely, but not exclusively, has single float machine direction knuckles (since in some instances a top MD yarn passes over a top layer CMD yarn and a stitching yarn before passing back down below the surface of the fabric). This results in a fabric which has a high level of cross machine direction support and provides excellent papermaking qualities.

It is preferred that the multi-layer forming fabrics of the present invention be thin or low in caliper in order to (i) keep the length of the drainage path (the distance water must flow from the sheet forming surface to the drainage inducing machine element) as short as possible and (ii) assist in reducing the total void space or water carrying capacity of the fabric to reduce papermachine drag load, power consumption and the potential for sheet rewetting. This is best accomplished when fine paper and newsprint producing fabrics are no greater than 0.38" in caliper, and even better when they are less than 0.32". For fabrics used in the formation of linerboard and corrugating medium, calipers no greater than 0.60" are desirable, and it is even more desirable if the thickness is less than 0.50". The use of flattened bottom layer cross machine direction yarns assists in reducing the caliper of the fabric to fit within these preferred ranges.

In yet another aspect of the present invention, triple layer forming fabrics which have a high level of top layer cross machine direction support are provided which are particularly suitable for auto-joining. As will be understood by those of skill in the art, the free space between bottom layer CMD yarns in any weave may be calculated as:

$$FS=25.4/PPI-D$$

where

FS=the free space between bottom CMD yarns in mm;

PPI=the bottom CMD yarn count in picks per inch; and

D=the diameter of the bottom CMD yarns in mm.

Accordingly, the maximum picks per inch for a given free space and yarn diameter is:

$$PPI_{max}=25.4/(FS+D)$$

(Note that in determining the pick count on the papermaking surface, pairs of stitching yarns having both fiber support and binding portions which weave substantially equivalent to a single yarn on the papermaking surface are counted as a single "pick.") One potential problem of designing fabrics to have a large number of picks per inch is that many auto-joining machines which are currently in use have reed wires that are as large as 0.1 mm or even 0.15 mm. As these auto-joining machines may only be used on fabrics in which the free space between yarns is at least the size of the reed wire, a fabric shall have a free space of at least 0.1 (or 0.15) mm to be auto-joined on these machines. However, if flattened bottom CMD yarns are employed, it is possible to use relatively high weight yarns yet have a fabric with a caliper less than a comparable fabric woven with circular yarns. Because of this, it may be possible to use less CMD yarns in the bottom fabric layer, thereby increasing the free distance between yarns. Accordingly, by weaving the fabric with flattened bottom CMD yarns it is possible to increase the number of bottom CMD yarns per inch while maintaining the necessary free space between adjacent bottom CMD yarns. This, in turn, allows an overall increase in the number of picks per inch.

Figure 10A:
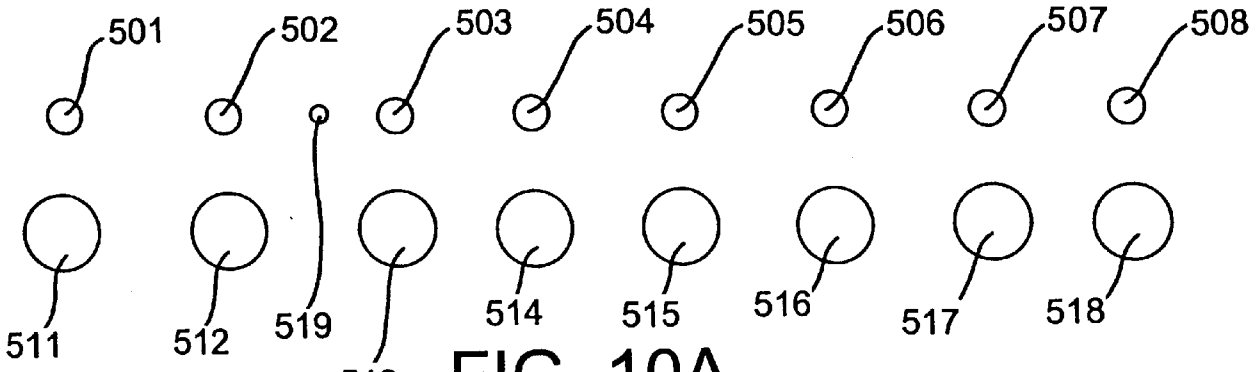
FIG. 10A is a cross sectional view, taken between adjacent machine direction yarns, of a conventional 16 harness triple layer fabric.

In a preferred embodiment of such an auto-joinable triple layer fabric, the ratio between the number of top layer CMD yarns and bottom layer CMD yarns is approximately two-to-one. One of the advantages provided by this embodiment is illustrated in FIG. 10. FIG. 10A is a cross section (taken between adjacent MD yarns) of a repeat of a conventional 16 harness triple layer fabric having eight top layer CMD yarns 501–508, eight bottom layer CMD yarns 511–518 and one stitching yarn 519. The top and bottom layer CMD yarns are arranged in a stacked configuration. As the bottom layer CMD yarns are of larger diameter than the top layer CMD yarns (to provide good wear characteristics and mechanical stability), it is the bottom fabric layer, as opposed to the top fabric layer, which limits the pick count (i.e., the number of CMD yarns per inch). Thus, for example, if the bottom layer CMD yarns 511–518 in FIG. 10A are 0.33 mm in diameter, and the top layer CMD yarns are 0.2 mm in diameter, and a free space of 0.1 mm is required between all CMD yarns (to allow use of an auto-joining machine), then the maximum pick count for the fabric may be calculated as:

$$PPI_{max}=25.4/(0.1+0.33)=59$$

Figure 10B:
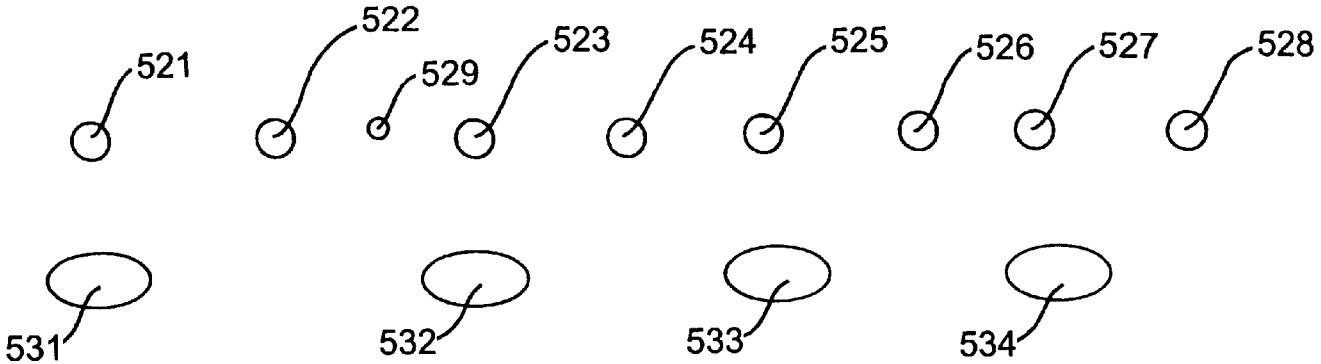
FIG. 10B is a cross sectional view, taken between adjacent machine direction yarns, of the conventional 16 harness triple layer fabric of FIG. 10A, wherein the bottom fabric layer cross machine direction yarns are replaced with flattened bottom fabric layer cross machine direction yarns that are positioned beneath every other top layer cross machine direction yarn.

If the fabric of FIG. 10A is modified to include flattened bottom CMD yarns, then a fabric such as that shown in FIG. 10B results. In this fabric, the bottom layer CMD yarns 531–534 have a major axis of 0.6 mm. Assuming that the top layer CMD yarns 521–528 are 0.20 mm in diameter, the maximum pick count for the fabric of FIG. 10B may be calculated as:

$$PPI_{max}=(2)25.4/(FS+2D)-(2)25.4/(0.1+0.60)=72.6$$

Thus, by modifying the fabric of FIG. 10A it can be seen in the above example that the maximum pick count may be increased from 59 to 72 picks per inch. Consequently, the fabric of FIG. 10B may be designed to be auto-joinable while having a greater number of top layer CMD yarns, and hence superior cross machine direction support on the papermaking surface, which may provide improved papermaking qualities.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paperstock is well understood by those of skill in the art, additional details regarding this aspect of the present invention will not be provided herein.

Figure 14:
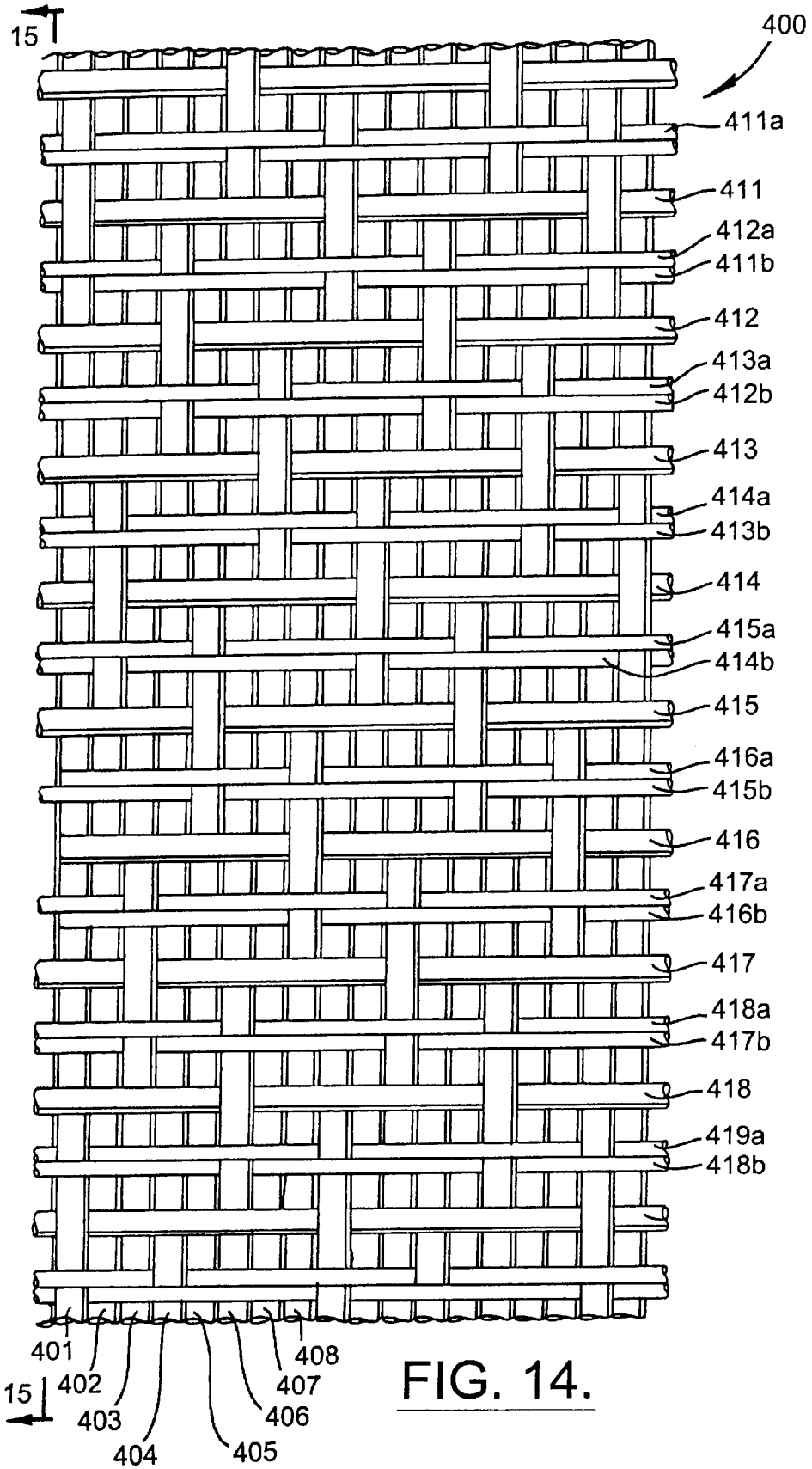
FIG. 14 is a top view of the paper side of an eight harness double layer fabric of the present invention.
Figure 15:
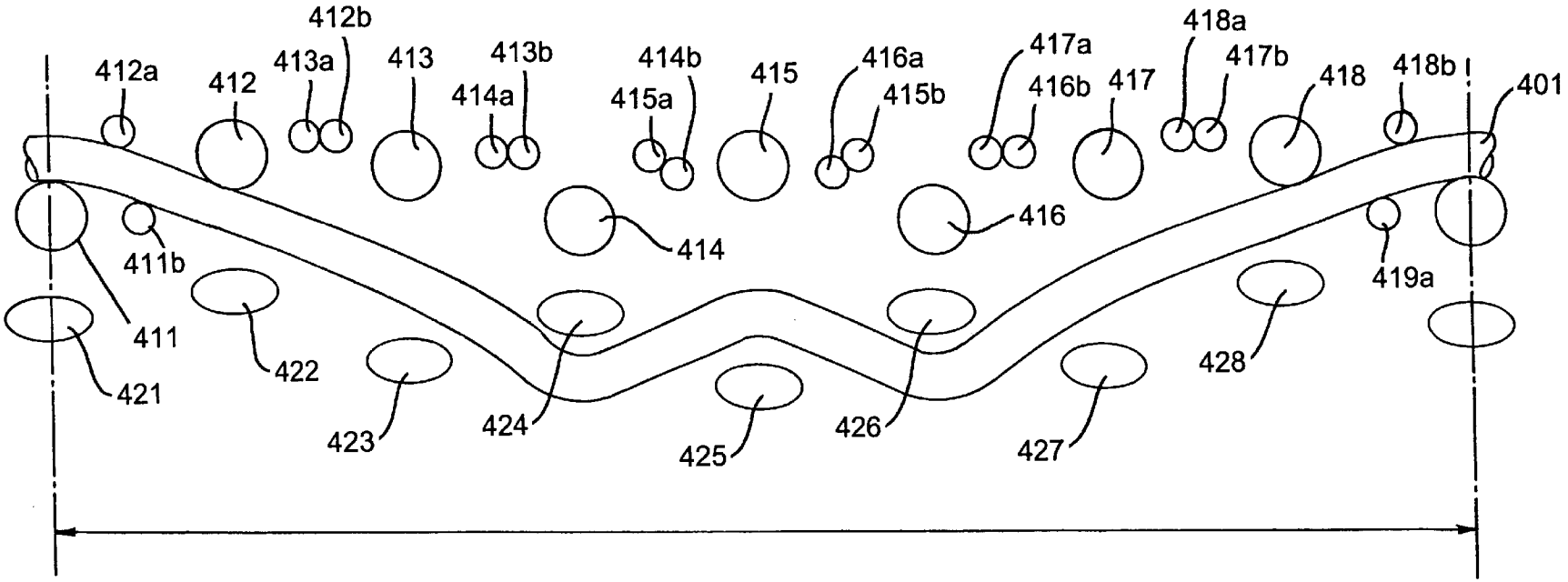
FIG. 15 is a section view taken along lines 15—15 of FIG. 14 showing the interrelationship between an exemplary MD yarn, primary and auxiliary CMD yarns of the fabric layer on the paper side of the fabric, and the CMD yarns of the fabric layer on the machine side of the fabric.

FIGS. 14 and 15 illustrate an exemplary fabric embodying another aspect of the present invention, wherein flattened bottom CMD yarns are employed in multi-layer fabrics which include auxiliary CMD yarns. As will be apparent to those of skill in the art, FIGS. 14 and 15 depict an eight harness double layered fabric broadly designated as 400. For ease of understanding this aspect of the present invention, fabric 400 will be described as if a base fabric layer were initially woven and then additional yarns added. The hypothetical base fabric layer includes MD yarns, top layer CMD yarns and bottom layer CMD yarns. With respect to fabric 400, the top layer CMD yarns which are used to form the base fabric layer are referred to as "primary" top layer CMD yarns, so as to distinguish them from the additional or "lauxiliary" top layer CMD yarns (described below) which are added to the base fabric layer. Of course, the papermaker's fabric 400 will typically be woven in a one step weaving process.

As shown in FIG. 14, the fabric 400 includes MD yarns 401–408 and primary top layer CMD yarns are interwoven in a twill pattern such that each primary top layer CMD yarn passes over seven MD yarns, passes beneath an MD yarn, and then repeats this pattern. The 8 harness fabric 400 is constructed so that the knuckles adjacent primary CMD yarns are offset in the cross-machine direction by three MD yarns.

FIG. 15 illustrates the bottom (machine) side layer of the base fabric 400. As (partially) shown in FIG. 15, the bottom CMD yarns 421–428 are flattened and are positioned below the primary top layer CMD yarns 411–418 described above. A typical MD yarn 401 is shown passing from the papermaking surface of the fabric 400 to interweave the flattened bottom CMD yarns; specifically in this instance, the MD yarn 401 passes over bottom CMD yarns 421, 422 and 423, under bottom CMD yarn 424, over bottom CMD yarn 425, under bottom CMD yarn 426 and over bottom CMD yarns 427 and 428.

As shown in FIGS. 14 and 15, in addition to the primary top layer CMD yarns 411–418, the fabric 400 also includes auxiliary top layer CMD yarns. As discussed in more detail below, each of the auxiliary top layer CMD yarns follows a weave pattern through the MD yarns that is identical to the weave pattern of a nearby primary top layer CMD yarn. For clarity, the auxiliary top layer CMD yarns are designated with the same component numeral as the primary top layer CMD yarn which has the identical weave pattern, but the auxiliary yarn includes either an "a" or a "b" after the component numeral.

As shown in both FIGS. 14 and 15, a pair of auxiliary top layer CMD yarns is positioned between each pair of adjacent primary top layer CMD yarns. These auxiliary yarns are positioned such that each primary top layer CMD yarn has on either side of it an auxiliary top layer CMD yarn which has an identical weave pattern. Thus, for example, primary top layer CMD yarn 413 has an auxiliary top layer CMD yarn on both its left (yarn 413*a*) and its right (yarn 413*b*). As is also seen in both FIGS. 14 and 15, the primary top layer CMD yarns are separated from the auxiliary yarns which have the same weave pattern by one auxiliary yarn (i.e., auxiliary yarn 412*b* falls between primary yarn 413 and auxiliary yarn 413*a*, and auxiliary yarn 414*a* falls between primary yarn 413 and auxiliary yarn 413*b*). Thus, each of the primary top layer CMD yarns has a pair of auxiliary top layer CMD yarns which have its identical weave pattern with respect to the MD yarns, where those auxiliary yarns are separated from their corresponding primary top layer CMD yarn by one auxiliary top layer CMD yarn.

As will be appreciated by those of skill in the art in light of the present disclosure, positioning an auxiliary top layer CMD yarn between two primary top layer CMD yarns, one of which has the identical weave pattern, the auxiliary top layer CMD yarn is urged toward the primary top layer CMD yarn having the identical weave pattern. However, because there is a second auxiliary CMD yarn positioned between each auxiliary top layer CMD yarn and its corresponding primary top layer CMD yarn, and because the second auxiliary top layer CMD yarn is biased in the opposite direction from its counterpart auxiliary top layer CMD yarn (because it is biased toward its own corresponding primary top layer CMD yarn due to its identical weave pattern), the pairs of auxiliary top layer CMD yarns tend to center one another within the gap between the primary top layer CMD yarns.

Another advantage offered by the fabric 400 is the presence of three separate twill lines. One twill line is formed by the floats of adjacent primary top layer CMD yarns. Another twill line is formed by the set of auxiliary top layer CMD yarns positioned above their corresponding primary top layer CMD yarns. The third twill line is formed by the set of auxiliary top layer CMD yarns positioned below their respective corresponding primary top layer CMD yarns in FIG. 14. Thus, every float of every CMD yarn, whether primary or auxiliary, resides within a twill line. This multiplicity of twill lines usually helps to obscure markings of the fabric 400 on the paper formed thereon.

As shown in FIG. 15, the double layered fabric includes flattened bottom CMD yarns. By using such flattened yarns, the caliper of the fabric 400 may be reduced, which reduces both the void volume and water carry of the fabric 400, without significantly compromising the wear characteristics or the mechanical stability of the bottom layer.

Those of skill in the art will also appreciate that the concepts of the present invention will also advantageously work in certain fabrics of a class of fabrics commonly referred to as "single x-pick double layer" fabrics, which comprise a set of machine direction yarns, sets of primary and auxiliary top cross machine direction yarns, and a set of bottom cross machine direction yarns. These single x-pick double layer fabrics typically are similar to the fabric 400, but only have a single auxiliary top cross machine direction yarn positioned between each pair of adjacent primary top cross machine direction yarns. Pursuant to the teachings of the present invention, the single x-pick double layer fabric is modified to include flattened bottom CMD yarns which are stacked below each primary top cross machine direction yarn. Preferably, each of the auxiliary yarns pass over at least six adjacent top machine direction yarns before passing beneath the papermaking surface, thereby providing a high degree of cross machine direction support on the papermaking surface. Additionally, it is preferred that each of the top MD yarns pass over no more than two top layer CMD yarns in a repeat.

Those skilled in this art will appreciate that this concept of auxiliary yarns oppositely biased toward adjacent primary CMD yarns can be applied to virtually any fabric, including plain weaves, twills, satins, and the like. It can be employed as the paper side of both double and triple layer fabrics, whether interlaced by common MD yarns (such as the fabric 400) or formed as separate fabric layers, such as those described in U.S. Pat. No. 5,277,967 to Zehle. It is preferred that the fabrics of the present invention have a harness repeat of greater than 2.

Preferably, the auxiliary CMD yarns are of a smaller diameter than the MD and CMD yarns making up the base structure fabric. The size of the smaller diameter auxiliary CM yarns is typically governed by the size and spacing of the papermaking surface CMD yarns of the base fabric. Generally, the diameter of the auxiliary CMD yarns is about one half the diameter of the primary cross machine direction yarns.

As will be appreciated by those of skill in the art in light of the present disclosure, the use of flattened bottom CMD yarns may be particularly advantageous in multi-layer fabrics, such as fabric 400 and the single x-pick double layer fabrics discussed above, which include auxiliary top layer CMD yarns which are not stacked above a bottom layer CMD yarn. The presence of these auxiliary top layer CMD yarns may facilitate drainage when flattened bottom CMD yarns are used, since the fabric is relatively open beneath these yarns, thereby providing a good drainage path. Consequently, even if flattened yarns having a relatively large major axis are used, sufficient drainage should exist due to the openings under the auxiliary top layer CMD yarns.

As will also be understood by those of skill in the art in light of the present disclosure, the use of flattened bottom CMD yarns may be particularly advantageous in triple layer forming fabrics which include pairs of stitching yarns between every pair of top layer cross machine direction yarns. If the bottom CMD yarns of a particular triple layer fabric are replaced with flattened bottom CMD yarns, the amount of open area in the bottom fabric layer is decreased to the extent that the major axis of the flattened yarn exceeds the diameter of the single yarn which they replaced. However, in triple layer fabrics which include pairs of stitching yarns, the bottom fabric layer tends to be quite open, as each of the pairs of stitching yarns typically only stitches with the bottom layer MD yarns at one place within a repeat (which is typically 10 or 12 bottom layer MD yarns), thus leaving a significant amount of open area. Accordingly, even if the major axis of the flattened bottom CMD yarns are 150%, or even more, of the diameter of the single bottom layer CMD yarn typically employed in top layer fabrics, typically there will still be sufficient drainage through the openings provided along the paths followed by the pairs of stitching yarns. Accordingly, the concepts of the present invention are particularly suitable for low caliper triple layer forming fabrics which include pairs of stitching yarns between each top layer CMD yarn.

Those skilled in this art will recognize that, although the plain weave and twill fabrics illustrated and described in detail herein are preferred, other fabric weaves, such as other twill weaves and satins may be constructed, that employ flattened bottom CMD yarns.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of cotton, wool, polypropylene, polyester, aramid, nylon, or the like. The skilled artisan should select a yarn material according to the particular application of the final fabric.

Regarding yarn dimensions, the particular size of the yarns is typically governed by the size and spacing of the papermaking surface, and the application in which the fabric will be used. In a typical embodiment of the triple layer fabrics disclosed herein, preferably the diameter of the top CMD yarns is between about 0.11 and 0.23 mm and the diameter of the top MD yarns is between about 0.11 and 0.20 mm. For these triple layer embodiments preferably the diameter of the bottom MD yarns is between about 0.17 and 0.45 mm, and the diameter of the stitching yarns is typically between about 0.11 and 0.20 mm. Preferably, the major axis of the flattened bottom CMD yarns is between about 0.22 and 0.70 mm. Those of skill in the art will appreciate that yarns having dimensions outside the above ranges may be used in certain applications, and that yarn dimensions within the recited ranges will depend to a large degree on the application in which the fabric is to be used (e.g., fine paper, newsprint, tissue, brown paper). In any event, it is preferable that the flattened bottom CMD yarns have a minor axis in the range of 50% to 150% the diameter of the bottom MD yarns.

It should also be noted that in many applications which include a relatively high number of floats on the papermaking surface that are formed by stitching yarns, the stitching yarns are of the same diameter as the top layer CMD yarns (to provide a coplanar papermaking surface). However, in situations where flattened bottom CMD yarns are employed in this type of fabric, it may be advantageous to use slightly smaller stitching yarns (e.g., with a diameter 10–20% less than the diameter of the top layer CMD yarns), as this may provide for a better drainage path between the flattened bottom CMD yarns.

As will be appreciated by those of skill in the art in light of the present disclosure, by using flattened bottom CMD yarns as taught herein, it is possible to significantly reduce the caliper of multi-layered papermaker's fabric without significantly reducing or otherwise affecting the mechanical stability of the fabric. Consequently, the fabrics of the present invention can have reduced void volume, and hence water carry, as compared to similar fabrics which have conventional circular bottom CMD yarns, yet should have similar performance from a mechanical perspective. In a preferred embodiment of the present invention, the fabrics further include a high density of stitching CMD yarn pairs (or other auxiliary top layer CMD yarns) which provide a high degree of cross direction support on the papermaking surface and which firmly bind the top and bottom fabric layers together, thus reducing or even eliminating interlayer wear. In these embodiments, the flattened bottom CMD yarns are typically stacked underneath the non-stitching top layer CMD yarns, so as to provide good drainage paths through the fabric adjacent and underneath the pairs of stitching yarns.

The foregoing embodiments are illustrative of the present invention, and are not to be construed as limiting thereof. The invention is defined by the following claims, with equivalents of the claims to be included therein.

That which is claimed:

1. A triple layer papermaker's forming, fabric comprising:

a set of top machine direction yarns, a set of top cross machine direction yarns and a set of auxiliary top cross machine direction yarns that are interwoven to form a top fabric layer having a papermaking surface;

a set of bottom machine direction yarns and a set of bottom cross machine direction yarns which are interwoven to form a bottom fabric layer having a machine side surface;

wherein said top cross machine direction yarns and said bottom cross machine direction yarns are substantially stacked;

wherein each yarn in said set of bottom cross machine directions yarns is a flattened cross machine direction yarn; and wherein said set of auxiliary top cross machine direction yarns comprises a set of stitching cross machine direction yarns which bind said top and bottom fabric layers together.

2. The papermaker's forming fabric of claim 1, wherein said set of stitching cross machine direction yarns comprises pairs of adjacent stitching yarns that are woven in said fabric such that when the first yarn of the pair is weaving in the top fabric layer the second yarn of the pair is passing downwardly from said top fabric layer to interweave with said bottom fabric layer.

3. The papermaker's forming fabric of claim 2, wherein said set of stitching yarns completes a weave pattern on the papermaking surface which is partially formed by the interweaving of the set of top machine direction yarns and the set of top cross machine direction yarns.

4. The papermaker's forming fabric of claim 3, wherein at least one of said stitching cross machine direction yarns is positioned between each pair of adjacent top cross machine direction yarns.

5. The papermaker's forming fabric of claim 3, wherein the aspect ratio of said flattened bottom cross machine direction yarns is less than 2.5.

6. The papermaker's forming fabric of claim 4, wherein said set of top machine direction yarns, said set of top cross machine direction yarns and said set of stitching cross machine direction yarns form a papermaking surface having single float machine direction knuckles.

7. The papermaker's forming fabric of claim 6, wherein the papermaking surface has a plain weave pattern.

8. The papermaker's forming fabric of claim 6, wherein the papermaking surface has a 1×2 twill pattern.

9. The papermaker's forming fabric of claim 2, wherein the yarns in said set of top machine direction yarns pass over no more than one of any two adjacent yarns in the set of top cross machine direction yarns.

10. The papermaker's forming fabric of claim 9, wherein said pairs of adjacent stitching yarns are positioned between adjacent yarns in said set of top cross machine direction yarns.

11. The papermaker's forming fabric of claim 10, wherein each of said stitching yarns serves as a locator yarn at the point where it crosses an adjacent stitching yarn in entering or leaving the papermaking surface.

12. The papermaker's forming fabric of claim 10, wherein said pairs of adjacent stitching yarns are interwoven with said top fabric layer such that they pass over no more than two adjacent yarns in the set of top layer machine direction yarns before passing under a yarn in the set of top layer machine direction yarns.

13. The papermaker's forming fabric of claim 10, wherein the aspect ratio of said bottom cross machine direction yarns is less than 2.5.

14. A double layer papermaker's forming fabric comprising:

a set of machine direction yarns, a set of top cross machine direction yarns, a set of auxiliary top cross machine direction yarns and a set of bottom cross machine direction yarns which are interwoven to form a top fabric layer having a papermaking surface and a bottom fabric layer having a machine side surface;

wherein each yarn in said set of bottom cross machine directions yarns is a flattened cross machine direction yarn;

wherein the yarns in the set of machine direction yarns interlace with the bottom fabric layer by passing under one bottom cross machine direction yarn, over the next adjacent bottom cross machine direction yarn, and under the next adjacent bottom cross machine direction yarn; and wherein at least one of said auxiliary top cross machine direction yarns is positioned between each adjacent pair of yarns in said set of top cross machine direction yarns.

15. The papermaker's forming fabric of claim 14, wherein a first and a second auxiliary top cross machine direction yarn is positioned between each adjacent pair of yarns in said set of top cross machine direction yarns; and wherein each first auxiliary top layer cross machine direction yarn has an interlacing pattern relative to said machine direction yarns that is identical to a first of said pair of adjacent top layer cross machine direction yarns, and wherein each second auxiliary top layer cross machine direction yarn has an interlacing pattern relative to said machine direction yarns that is identical to a second of said pair of adjacent top layer cross machine direction yarns, and wherein said first auxiliary top layer cross machine direction yarn is positioned between said second top layer cross machine direction yarn and said second auxiliary top layer cross machine direction yarn.

16. The papermaker's forming fabric of claim 15, wherein said top layer cross machine direction yarns have a first diameter, and said auxiliary top layer cross machine direction yarns have a second diameter that is smaller than said first diameter.

17. The papermaker's forming fabric of claim 14, wherein one auxiliary top layer cross machine direction yarn is positioned between each adjacent pair of yarns in said set of top layer cross machine direction yarns, and wherein each of said auxiliary yarns passes over at least six adjacent yarns in said set of top machine direction yarns before passing under a yarn in said set of top machine direction yarns.

18. The papermaker's forming fabric of claim 14, wherein each of said top machine direction yarns passes over no more than two top layer cross machine direction yarns in a repeat.

19. An auto-joinable multi-layer papermaker's forming fabric comprising:

at least one set of machine direction yarns, a set of top cross machine direction yarns and a set of bottom cross machine direction yarns interwoven to form a multi-layer forming fabric having a top fabric layer and a bottom fabric layer;

wherein at least selected yarns of said set of bottom cross machine direction yarns are flattened cross machine direction yarns, wherein the ratio between the number of yarns in the set of top cross machine direction yarns and the set of bottom cross machine direction yarns is approximately one-to-one; and wherein said fabric has a top layer cross machine direction yarn count of at least 80 picks per inch.

20. The papermaker's fabric of claim 19, wherein adjacent of said bottom cross machine direction yarns are spaced apart by at least 0.1 mm.

21. A method of making paper, said method comprising the steps of:

(a) providing a multi-layer papermaker's forming fabric comprising:

at least one set of machine direction yarns, a set of top cross machine direction yarns, a set of auxiliary top cross machine direction yarns and a set of bottom cross machine direction yarns which are interwoven to form a top fabric layer having a papermaking surface and a bottom fabric layer having a machine side surface;

wherein each yarn in said set of bottom cross machine directions yarns is a flattened cross machine direction yarn having an aspect ratio of less than 2.5. and wherein said set of auxiliary top cross machine direction yarns comprises a set of stitching cross machine direction yarns which bind said top and bottom fabric layers together;

(b) applying paper stock to said papermaker's fabric; and (c) removing moisture from said paper stock.

22. The method of claim 21, wherein said top cross machine direction yarns and said bottom cross machine direction yarns are substantially stacked and wherein said fabric further comprises a set of auxiliary top cross machine direction yarns.

23. A triple layer papermaker's forming fabric comprising:

a set of top machine direction yarns and a set of top cross machine direction yarns that are interwoven to form a top fabric layer having a papermaking surface;

a set of bottom machine direction yarns and a set of bottom cross machine direction yarns having a flattened cross-section which are interwoven to form a bottom fabric layer having a machine side surface; and a set of stitching cross machine direction yarns which bind said top and bottom fabric layers together;

wherein said set of stitching cross machine direction yarns comprises pairs of adjacent stitching yarns that are woven in said fabric such that when the first yarn of the pair is weaving in the top fabric layer the second yarn of the pair is passing downwardly from said top fabric layer to interweave with said bottom fabric layer.

24. The papermaker's forming fabric of claim 23, wherein the yarns in said set of top machine direction yarns pass over no more than one of any two adjacent yarns in the set of top cross machine direction yarns.

* * * * *